US008989917B2

(12) United States Patent
Kumar

(10) Patent No.: US 8,989,917 B2
(45) Date of Patent: Mar. 24, 2015

(54) SYSTEM, METHOD, AND COMPUTER SOFTWARE CODE FOR CONTROLLING SPEED REGULATION OF A REMOTELY CONTROLLED POWERED SYSTEM

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 235 days.

(21) Appl. No.: 13/618,970

(22) Filed: Sep. 14, 2012

(65) Prior Publication Data

US 2013/0018531 A1 Jan. 17, 2013

Related U.S. Application Data

(63) Continuation-in-part of application No. 12/126,858, filed on May 24, 2008, now Pat. No. 8,295,993, which is a continuation-in-part of application No. 11/795,443, filed on Jun. 19, 2007, now abandoned, and a continuation-in-part of application No. 12/061,444, filed on Apr. 2, 2008, which is a (Continued)

(51) Int. Cl.

| | |
|---|---|
| ***G05D 1/00*** | (2006.01) |
| ***G06F 7/00*** | (2006.01) |
| ***G06F 17/00*** | (2006.01) |
| ***B61L 3/00*** | (2006.01) |
| ***B61L 15/00*** | (2006.01) |
| ***B61L 25/02*** | (2006.01) |
| ***B61L 27/00*** | (2006.01) |

(52) U.S. Cl.

CPC ..... *B61L 3/006* (2013.01); *B61L 15/0027* (2013.01); *B61L 15/009* (2013.01); *B61L 25/025* (2013.01); *B61L 27/0038* (2013.01); *B61L 2205/04* (2013.01)

USPC ..... 701/2; 701/19; 701/20; 701/400

(58) Field of Classification Search

CPC ..... B61L 27/0027; B61L 3/006; B61L 3/127; B61L 27/0077; G05B 13/021

USPC ..... 701/2, 19, 20, 400

See application file for complete search history.

(56) References Cited

U.S. PATENT DOCUMENTS

| | | | | |
|---|---|---|---|---|
| 5,487,516 | A * | 1/1996 | Murata et al. | 246/182 C |
| 6,600,978 | B2 * | 7/2003 | Nagasu et al. | 701/19 |
| 6,853,890 | B1 * | 2/2005 | Horst et al. | 701/20 |
| 7,021,588 | B2 * | 4/2006 | Hess et al. | 246/186 |
| 7,236,859 | B2 * | 6/2007 | Horst et al. | 701/19 |
| 8,030,871 | B1 * | 10/2011 | Young et al. | 318/461 |
| 8,154,227 | B1 * | 4/2012 | Young et al. | 318/255 |
| 8,374,739 | B2 * | 2/2013 | Yamamoto et al. | 701/20 |
| 8,532,842 | B2 * | 9/2013 | Smith et al. | 701/2 |

(Continued)

FOREIGN PATENT DOCUMENTS

JP 09193804 A * 7/1997 ..... B61L 23/14

*Primary Examiner* — Khoi Tran
*Assistant Examiner* — Jorge Peche
(74) *Attorney, Agent, or Firm* — GE Global Patent Operation; John A. Kramer

(57) ABSTRACT

A system for operating a remotely controlled powered system, the system including a feedforward element configured to provide information to the remotely controlled powered system to establish a velocity, and a feedback element configured to provide information from the remotely controlled powered system to the feedforward element. A method and a computer software code are further disclosed for operating the remotely controlled powered system.

16 Claims, 20 Drawing Sheets

Related U.S. Application Data continuation-in-part of application No. 11/669,364, filed on Jan. 31, 2007, and a continuation of application No. 11/385,354, filed on Mar. 20, 2006.

(60) Provisional application No. 60/894,039, filed on Mar. 9, 2007, provisional application No. 60/939,852, filed on May 24, 2007, provisional application No. 60/942,559, filed on Jun. 7, 2007, provisional application No. 60/939,950, filed on May 24, 2007, provisional application No. 60/849,100, filed on Oct. 2, 2006, provisional application No. 60/850,885, filed on Oct. 10, 2006, provisional application No. 60/939,848, filed on May 23, 2007.

(56) References Cited

U.S. PATENT DOCUMENTS

| | | | | |
|---|---|---|---|---|
| 2003/0107548 | A1* | 6/2003 | Eun et al. | 345/156 |
| 2004/0026574 | A1* | 2/2004 | Seifert | 246/5 |
| 2004/0143374 | A1* | 7/2004 | Horst et al. | 701/19 |
| 2005/0120904 | A1* | 6/2005 | Kumar et al. | 105/35 |
| 2007/0129852 | A1* | 6/2007 | Chen et al. | 701/1 |
| 2007/0233364 | A1* | 10/2007 | Kumar | 701/200 |
| 2008/0128563 | A1* | 6/2008 | Kumar et al. | 246/187 A |
| 2008/0147256 | A1* | 6/2008 | Liberatore | 701/19 |
| 2009/0254239 | A1* | 10/2009 | Daum et al. | 701/29 |
| 2012/0245770 | A1* | 9/2012 | Yamamoto et al. | 701/20 |

* cited by examiner

SYSTEM, METHOD, AND COMPUTER SOFTWARE CODE FOR CONTROLLING SPEED REGULATION OF A REMOTELY CONTROLLED POWERED SYSTEM

CROSS-REFERENCE TO RELATED APPLICATIONS

This application claims priority to and is a continuation-in-part of U.S. application Ser. No. 12/126,858, filed on 24 May 2008 (the "'858 application"), which claims priority to and is a continuation-in-part of U.S. application Ser. No. 11/765,443, filed on 19 Jun. 2007 (the "'443 application"), which claims priority to U.S. Provisional Application No. 60/894,039, filed on 9 Mar. 2007 (the "'039 application"), and U.S. Provisional Application No. 60/939,852, filed on 24 May 2007 (the "'852 application").

The '858 application also claims priority to U.S. Provisional Application No. 60/939,848, filed on 23 May 2007 (the "'848 application"), U.S. Provisional Application No. 60/942,559, filed on 7 Jun. 2007 (the "'559 application"), and U.S. Provisional Application No. 60/939,950, filed on 23 May 2007 (the "'950 application"). The '858 application also claims priority to and is a continuation-in-part of U.S. application Ser. No. 12/061,444, filed on 2 Apr. 2008 (the "'444 application"), and incorporated herein by reference in its entirety.

The '443 application claims priority to and is a continuation-in-part of U.S. application Ser. No. 11/669,364, filed on 31 Jan. 2007 (the "'364 application"), which claims priority to U.S. Provisional Application No. 60/849,100, filed on 2 Oct. 2006 (the "'100 application"), and U.S. Provisional Application No. 60/850,885, filed on 10 Oct. 2006 (the "'885 application").

The '364 application claims priority to and is a continuation-in-part of U.S. application Ser. No. 11/385,354, filed on 20 Mar. 2006 (the "'354 application").

The entire disclosures of each of the above applications (e.g., the '858 application, the '443 application, the '039 application, the '852 application, the '848 application, the '559 application, the '950 application, the '444 application, the '364 application, the '100 application, the '885 application, and the '354 application) are incorporated by reference in their entirety.

BACKGROUND

The inventive subject matter described herein relates to a powered system, such as a train, an off-highway vehicle, a marine vessel, a transport vehicle, an agriculture vehicle, and/or a stationary powered system. At least one embodiment described herein relates to a system, method, and computer software code for remotely controlling a powered system to improve efficiency of operation of the powered system.

Some powered systems such as, but not limited to, off-highway vehicles, marine diesel powered propulsion plants, stationary diesel powered systems, transport vehicles such as transport buses, agricultural vehicles, and rail vehicle systems or trains, are typically powered by one or more diesel power units, or diesel-fueled power generating units. With respect to rail vehicle systems, a diesel power unit is usually a part of at least one locomotive powered by at least one diesel internal combustion engine and the train further includes a plurality of rail cars, such as freight cars. Usually more than one locomotive is provided, wherein the locomotives are considered a locomotive consist. A locomotive consist is a group of locomotives that operate together in operating a train. Locomotives are complex systems with numerous subsystems, with each subsystem being interdependent on other subsystems.

An operator is usually aboard a locomotive to insure the proper operation of the locomotive, and when there is a locomotive consist, the operator is usually aboard a lead locomotive. In addition to ensuring proper operations of the locomotive or locomotive consist, the operator also is responsible for determining operating speeds of the train and forces within the train that the locomotives are part of. To perform this function, the operator generally must have extensive experience with operating the locomotive and various trains over the specified terrain. This knowledge is needed to comply with prescribeable operating parameters, such as speeds, emissions, and the like that may vary with the train location along the track. Moreover, the operator is also responsible for ensuring that in-train forces remain within acceptable limits.

In marine applications, an operator is usually aboard a marine vessel to ensure the proper operation of the vessel, and when there is a vessel consist, the lead operator is usually aboard a lead vessel. As with the locomotive example cited above, a vessel consist is a group of vessels that operate together in operating a combined mission. In addition to ensuring proper operations of the vessel, or vessel consist, the lead operator also is responsible for determining operating speeds of the consist and forces within the consist that the vessels are part of. To perform this function, the operator generally must have extensive experience with operating the vessel and various consists over the specified waterway or mission. This knowledge is needed to comply with prescribeable operating speeds and other mission parameters that may vary with the vessel location along the mission. Moreover, the operator is also responsible for assuring mission forces and location remain within acceptable limits.

In the case of multiple diesel power powered systems, which by way of example and limitation, may reside on a single vessel, power plant or vehicle or power plant sets, an operator is usually in command of the overall system to ensure the proper operation of the system, and when there is a system consist, the operator is usually aboard a lead system. Defined generally, a system consist is a group of powered systems that operate together in meeting a mission. In addition to ensuring proper operations of the single system, or system consist, the operator also is responsible for determining operating parameters of the system set and forces within the set that the system are part of. To perform this function, the operator generally must have extensive experience with operating the system and various sets over the specified space and mission. This knowledge is needed to comply with prescribeable operating parameters and speeds that may vary with the system set location along the route. Moreover, the operator is also responsible for ensuring that in-set forces remain within acceptable limits.

Not all locomotives utilize an operator to control the locomotives from within the locomotive. Remotely controlled locomotives (RCL) exist. A RCL is a locomotive that, through use of a radio transmitter and receiver system, can be operated by a person not physically located at the controls within the confines of the locomotive cab. The systems are designed to be fail-safe; that is, if communication is lost, the locomotive is brought to a stop automatically. Other power systems may be operated remotely at times as well depending on an intended purpose.

A typical RCL system has an operator control unit, which is in wireless communication with a locomotive control unit which is on-board a RCL. The operator control unit is used by an operator to control the RCL. The locomotive control unit may include a transmitter for transmitting locomotive information, such as a condition sensed by one or more sensors to the operator control unit. The locomotive control unit is configured to control the throttle and braking systems of the RCL.

A RCL may be used to traverse various terrains at speeds determined by the operator who is remotely controlling the RCL. However when using the RCL as a speed regular, terrain information is not available to the operator. Therefore, the speed regulator performance is not optimum. Operators could more effectively operate a RCL if information pertaining to terrain information is available. Therefore operators as well as owners of trains being operated remotely would benefit from having such systems operated more effectively where improved emissions and performance are realized.

BRIEF DESCRIPTION

One or more embodiments of the inventive subject matter disclose a system, method, and computer software code for remotely operating a powered system, such as but not limited to a remotely controlled vehicle, such as a locomotive. A system for operating a remotely controlled powered system includes a feedforward gains element (also referred to as a feedforward element or prediction element) that is configured to provide information to the remotely controlled powered system to establish a velocity, and a feedback gains element (also referred to as a feedback element or a reporting element) configured to provide information from the remotely controlled powered system to the feedforward gains element. The term "element" can refer to a processing device (e.g., controller, processor, and the like, along with associated software and/or hard-wired logic or instructions) that performs the operations described herein.

In one embodiment, a system (e.g., for remotely controlling movement of a vehicle) includes a feedforward element and a feedback element. The feedforward element is configured to be disposed onboard a remotely controlled vehicle and to receive an operator command for the vehicle from an operator control unit disposed off-board of the vehicle. The feedforward element also is configured to predict movements of the vehicle over an upcoming segment of a route being traveled by the vehicle based on the operator command and terrain information of the upcoming segment of the route. The feedback element is configured to be disposed onboard the vehicle and to determine an actual movement of the vehicle. The feedforward element is configured to communicate the predicted movements of the vehicle to the operator control unit and the feedback element is configured to communicate the actual movement of the vehicle to the operator control unit such that an operator can examine the predicted movements and the actual movement in order to remotely control the vehicle.

In another embodiment, a method (e.g., for remotely controlling movement of a vehicle) includes receiving an operator command for remotely controlling a vehicle from an operator control unit disposed off-board of the vehicle, predicting movements of the vehicle over an upcoming segment of a route being traveled by the vehicle, the predicted movements based on the operator command and terrain information of the upcoming segment of the route, and monitoring actual movement of the vehicle as the vehicle travels along the route. The actual movement includes at least one of an actual speed or actual acceleration at which the vehicle moves. The method also includes communicating the predicted movements of the vehicle and the at least one of actual speed or actual acceleration of the vehicle to the operator control unit so that an operator can use the predicted movements and the at least one of actual speed or actual acceleration to determine how to remotely control the vehicle.

In another embodiment, an operator control unit (e.g., for a vehicle) includes an input device, a communication device, and an output device. The input device is configured to receive an operator command for a remotely controlled vehicle. The communication device is configured to transmit the operator command to a feedforward element remotely disposed onboard the vehicle. The communication device also is configured to receive predicted movements of the vehicle over an upcoming segment of a route being traveled by the vehicle and at least one of actual speed or actual acceleration of the vehicle. The predicted movements are determined by the feedforward element and based on the operator command and terrain information of the upcoming segment of the route. The output device is configured to present the predicted movements and the at least one of actual speed or actual acceleration of the vehicle to an operator such that the operator can examine the predicted movements and the at least one of actual speed or actual acceleration of the vehicle in order to remotely control the vehicle using the input device.

A method for operating a remotely controlled powered system is disclosed as providing for communicating information from an operator remote from the remotely controlled powered system to the remotely controlled powered system to establish a velocity. Information is communicated in a closed-loop configuration from the remotely controlled powered system to the operator.

A computer software code operating within a processor and storable on a tangible and non-transitory computer readable media for operating a remotely controlled powered system is further disclosed as having a computer software module for communicating information from an operator remote from the remotely controlled powered system to the remotely controlled powered system to establish a velocity. A computer software module for communicating information in a closed-loop configuration from the remotely controlled powered system to the operator is further disclosed.

BRIEF DESCRIPTION OF THE DRAWINGS

A more particular description of the inventive subject matter briefly described above will be rendered by reference to specific embodiments thereof that are illustrated in the appended drawings. Understanding that these drawings depict only some embodiments of the inventive subject matter and are not therefore to be considered to be limiting of the entire scope of the inventive subject matter, embodiments of the inventive subject matter will be described and explained with additional specificity and detail through the use of the accompanying drawings in which.

DETAILED DESCRIPTION

Figure 1:
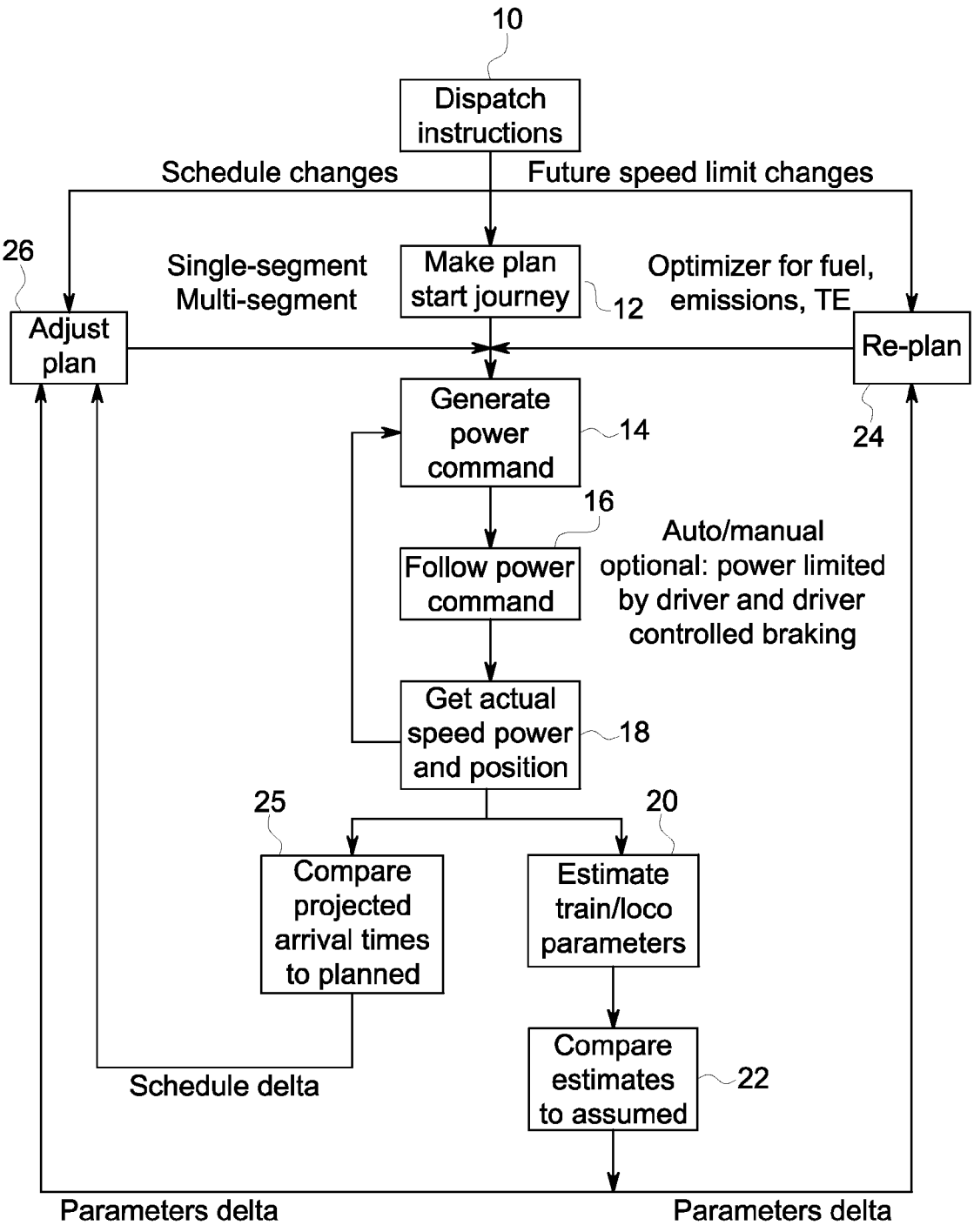
FIG. 1 depicts a flow chart of one embodiment of a trip optimization process.

Reference will now be made in detail to the embodiments consistent with the inventive subject matter, examples of which are illustrated in the accompanying drawings. Wherever possible, the same reference numerals used throughout the drawings refer to the same or like parts.

Though embodiments of the inventive subject matter are described with respect to rail vehicles, or railway transportation systems, specifically trains and locomotives having diesel engines, embodiments of the inventive subject matter also are applicable for other uses, such as but not limited to off-highway vehicles, marine vessels, stationary units, agricultural vehicles, and transport buses, each which may use at least one diesel engine, or diesel internal combustion engine, or another type of engine or power source (e.g., battery). Toward this end, when discussing a specified mission or plan, the mission or plan includes a task or requirement to be performed by the powered system, such as travel along a designated route to a designated location within a designated time period.

Therefore, with respect to railway, marine, transport vehicles, agricultural vehicles, or off-highway vehicle applications, the mission or plan may refer to the movement of the powered system from a present location to a destination. In the case of stationary applications, such as but not limited to a stationary power generating station or network of power generating stations, a specified mission or plan may refer to an amount of wattage (e.g., MW/hr) or other parameter or requirement to be provided by the powered system. Likewise, operating condition of the power generating unit may include one or more of speed, load, fueling value, timing, etc. Furthermore, though diesel powered systems are disclosed, embodiments of the inventive subject matter may also be utilized with non-diesel powered systems, such as but not limited to natural gas powered systems, bio-diesel powered systems, etc.

Furthermore, as disclosed herein, the powered systems may include multiple engines, other power sources, and/or additional power sources, such as, but not limited to, battery sources, voltage sources (such as but not limited to capacitors), chemical sources, pressure based sources (such as but not limited to spring and/or hydraulic expansion), current sources (such as but not limited to inductors), inertial sources (such as but not limited to flywheel devices), gravitational-based power sources, and/or thermal-based power sources.

In one example involving marine vessels, a plurality of tugs may be operating together where all tugs are moving the same larger vessel, and where each tug is linked in time to accomplish the mission of moving the larger vessel. In another example, a single marine vessel may have a plurality of engines. Off-Highway Vehicle (OHV) applications may involve a fleet of vehicles that have a same mission to move earth, from location A to location B, where each OHV is linked in time to accomplish the mission. With respect to a stationary power generating station, a plurality of stations may be grouped together for collectively generating power for a specific location and/or purpose. In another embodiment, a single station is provided, but with a plurality of generators making up the single station. In one example involving locomotive vehicles, a plurality of powered systems may be operated together where all are moving the same larger load, where each system is linked in time to accomplish the mission of moving the larger load. In another embodiment, a locomotive vehicle may have more than one diesel powered system.

Additionally, though examples provided herein are also directed to remote control locomotives, these examples are also applicable to other powered systems that are remotely controlled.

Embodiments of the inventive subject matter solve problems in the art by providing a system, method, and computer implemented method, such as a computer software code, for controlling a remote controlled powered system to improve efficiency of operation of the powered system. With respect to locomotives, embodiments of the inventive subject matter are also operable when the locomotive consist is operating in distributed power (DP) operations.

An apparatus, such as a data processing system, including a CPU, memory, I/O, program storage, a connecting bus, and other appropriate components, can be programmed or otherwise designed to facilitate the practice of the method of the inventive subject matter. Such a system would include appropriate program means (e.g., one or more sets of instructions that direct a processing device, such as a processor, to perform one or more operations) for executing the method of the inventive subject matter.

Also, an article of manufacture, such as a pre-recorded disk or other similar computer program product, for use with a data processing system, can include a storage medium and program means recorded thereon for directing the data processing system to facilitate the practice of the method of the inventive subject matter. Such apparatus and articles of manufacture also fall within the spirit and scope of the inventive subject matter.

Broadly speaking, one technical effect is to control a remote controlled powered system where terrain information is used to control speed of the powered system. To facilitate an understanding of embodiments of the inventive subject matter, it is described hereinafter with reference to specific implementations thereof. Embodiments of the inventive subject matter may be described in the general context of computer-executable instructions, such as program modules, being executed by any device, such as but not limited to a computer, designed to accept data, perform prescribed mathematical and/or logical operations usually at high speed, where results of such operations may or may not be displayed. Generally, program modules include routines, programs, objects, components, data structures, etc. that performs particular tasks or implement particular abstract data types. For example, the software programs that underlie embodiments of the inventive subject matter can be coded in different programming languages, for use with different devices, or platforms. In the description that follows, examples of the inventive subject matter may be described in the context of a web portal that employs a web browser. It will be appreciated, however, that the principles that underlie embodiments of the inventive subject matter can be implemented with other types of computer software technologies as well.

Moreover, one or more embodiments of the inventive subject matter may be practiced with other computer system configurations, including hand-held devices, multiprocessor systems, microprocessor-based or programmable consumer electronics, minicomputers, mainframe computers, and the like. One or more embodiments of the inventive subject matter may also be practiced in distributed computing environments where tasks are performed by remote processing devices that are linked through a communications network. In a distributed computing environment, program modules may be located in both local and remote computer storage media including memory storage devices. These local and remote computing environments may be contained entirely within the powered system, or adjacent powered systems in a consist, or off-board in wayside or central offices where wireless communication is used.

Throughout this document, the term "consist" is used. As used herein, a consist may be described as having one or more powered vehicles (e.g., vehicles that are capable of generating propulsive force to propel themselves) in succession, connected together so as to provide motoring and/or braking capability. The powered vehicles may be directly connected together where no non-powered vehicles (e.g., vehicles that do not generate propulsive force to propel themselves, but may consume energy to power one or more non-propulsion loads) are between the powered vehicles. A vehicle system (e.g., a train) can have more than one consist. For example, there can be a lead consist and one or more remote consists, such as midway in the line of vehicles of the vehicle system and another remote consist at the end (or other position) of the vehicle system. A consist may have a single powered vehicle or multiple powered vehicles. For example, a consist may include a first powered vehicle and one or more trail powered vehicles. Though a leading powered vehicle along a direction of travel is usually viewed as the lead powered vehicle, the lead powered vehicle in a multiple powered vehicle consist may be physically located in a trailing position along the direction of travel. Though a consist is usually viewed as involving successive powered vehicles directly connected with each other, a consist may also be recognized as a consist even when at least one non-powered vehicle separates the powered vehicles, such as when the consist is configured for DP operation (e.g., where throttle and braking commands are relayed from the lead powered vehicle to the remote powered vehicles by a radio link or physical cable). Toward this end, the term consist should be not be considered a limiting factor when discussing multiple powered vehicles within the same vehicle system.

As disclosed herein, the idea of a consist may also be applicable when referring to powered systems such as, but not limited to, marine vessels, off-highway vehicles, transportation vehicles, agricultural vehicles, and/or stationary power plants, that operate together so as to provide motoring, power generation, and/or braking capability. Therefore, even though the term consist is used herein in regards to certain illustrative embodiments, this term may also apply to other powered systems. Similarly, sub-consists may exist. For example, the powered system may have more than one power generating unit. For example, a power plant may have more than one diesel electric power unit where optimization may be at the sub-consist level. Likewise, a powered vehicle may have more than one power unit (e.g., engine).

Referring now to the drawings, embodiments of the inventive subject matter will be described. One or more embodiments of the inventive subject matter can be implemented in numerous ways, including as a system (including a computer processing system), a method (including a computerized method), an apparatus, a computer readable medium, a computer program product, a graphical user interface, including a web portal, or a data structure tangibly fixed in a computer readable memory. Several embodiments of the inventive subject matter are discussed below.

FIG. 1 depicts an illustration of a flow chart of an embodiment of the inventive subject matter. As illustrated, instructions are input specific to planning a trip for a vehicle system 31 (e.g., a train) either onboard or from a remote location, such as a dispatch center 10. Such input information includes, but is not limited to, position of the vehicle system, consist description (such as powered vehicle models), vehicle power description, performance of powered vehicle traction transmission, consumption of engine fuel as a function of output power, generation of emissions as a function of output power, cooling characteristics, the intended or designated trip route (which may include effective route grade and curvature as function of location, or an "effective grade" component to reflect curvature following standard railroad practices), the vehicle system represented by vehicle makeup and loading together with effective drag coefficients, and/or trip desired parameters including, but not limited to, start time and location, end location, desired travel time, crew (user and/or operator) identification, crew shift expiration time, and route.

This data may be provided to a powered vehicle 42 (e.g., a locomotive) in a number of ways, such as, but not limited to, an operator manually entering this data into the powered vehicle 42 via an onboard display, inserting a memory device such as a "hard card" and/or USB drive containing the data into a receptacle aboard the powered vehicle 42, and transmitting the information via wireless communication from a central or wayside location 41, such as a track signaling device and/or a wayside device, to the powered vehicle 42. Powered vehicle 42 and vehicle system 31 load characteristics (e.g., drag) may also change over the route (e.g., with altitude, ambient temperature and condition of the route and vehicles), and the plan may be updated to reflect such changes as needed by any of the methods discussed above and/or by real-time autonomous collection of vehicle/vehicle system conditions. This includes, for example, changes in characteristics of the powered vehicles and/or vehicle system as detected by monitoring equipment located on or off-board the powered vehicle(s) 42.

The route signal system determines the allowable speed of the vehicle system 31. There are many types of route signal systems and operating rules associated with each of the signals. For example, some signals have a single light (on/off), some signals have a single lens with multiple colors, and some signals have multiple lights and colors. These signals can indicate that the track is clear and the vehicle system may proceed at a designated allowable speed. The signals can also indicate that a reduced speed or stop is required. This reduced speed may need to be achieved immediately, or at a certain location (e.g., prior to the next signal or crossing).

The signal status is communicated to the vehicle system 31 and/or operator through various devices. Some systems have circuits in the route and inductive pick-up coils on the powered vehicles 42. Other systems have wireless communications systems. Signal systems can also require the operator to visually inspect the signal and take the appropriate actions.

The signaling system may interface with an on-board signal system and adjust the speed of the powered vehicle 42 and/or vehicle system 31 according to the inputs and the appropriate operating rules. For signal systems that require the operator to visually inspect the signal status, an operator screen disposed onboard the vehicle system 31 can present the appropriate signal options for the operator to enter based on the location of the vehicle system 31. The type of signal systems and operating rules, as a function of location, may be stored in an onboard database 63.

Based on the data that is input, a trip plan 12 which reduces fuel use and/or emissions produced subject to speed limit constraints along the route with desired start and end times is computed. As used herein, the term "optimal" includes a maximized quantity, a minimized quantity, or another increased or decreased quantity, as appropriate. For example, an optimal trip plan 12 that reduces fuel use and/or emission generation can reduce the amount of fuel consumed and/or emissions generated during a trip by a vehicle system relative to the same vehicle system traveling over the same route according to another, different trip plan. However, the optimized trip plan may not reduce the fuel consumed and/or emissions generated to the lowest possible levels. For example, the optimal trip plan can include designated operational settings, such as throttle settings, brake settings, power output, speed, and the like, expressed as a function of time and/or distance along a route. The other, different trip plan may include one or more other, different operational settings than the optimal trip plan at the same time and/or location such that more fuel is consumed and/or more emissions are generated by following the other, different trip plan than the optimal trip plan. The trip plan 12 contains the designated speed and/or power (notch) settings that the vehicle system is to follow, expressed as a function of distance and/or time, and such operating limits, including but not limited to, an upper designated limitation on notch power and brake settings, speed limits expressed as a function of location, and the expected fuel used and emissions generated. In an embodiment, the value for the notch setting is selected to obtain throttle change decisions about once every 10 to 30 seconds. Alternatively, the throttle change decisions may occur more or less frequently, if needed and/or desired to follow an optimal speed profile. The trip plan can provide power settings for the vehicle system, either at the vehicle system level, consist level, and/or individual powered vehicle level. Power comprises braking power, motoring power, and airbrake power. In another embodiment, instead of operating at the traditional discrete notch power settings, one embodiment of the inventive subject matter is able to select a continuous power setting determined as optimal for the profile selected. Thus, for example, if an optimal profile specifies a notch setting of 6.8, instead of operating at notch setting 7 (assuming discreet notch settings such as 6, 7, 8, and so on), the powered vehicle 42 can operate at a notch setting of 6.8. Allowing such intermediate power settings may bring additional efficiency benefits as described below.

The procedure used to compute the trip plan can be any number of methods for computing a power sequence that drives the vehicle system 31 to reduce (e.g., minimize) fuel consumed and/or emissions generated subject to operating and schedule constraints, as summarized below. In some cases, the trip plan may be close enough to one previously determined, owing to the similarity of the configuration of the vehicle system, the route, and/or environmental conditions. In these cases, it may be sufficient to look up the previously determined trip plan within a database 63 and attempt to follow the previously determined trip plan. When no previously computed trip plan is suitable, methods to compute a new one include, but are not limited to, direct calculation of the new trip plan using differential equation models which approximate the physics of motion of the vehicle system. The setup involves selection of a quantitative objective function, commonly a weighted sum (integral) of model variables that correspond to rate of fuel consumption and/or emissions generation, plus a term to penalize excessive throttle variation.

An optimal control formulation is set up to reduce (e.g., minimize) the quantitative objective function subject to constraints including but not limited to, speed limits lower and/or upper limits on power (e.g., throttle) settings, upper limits on cumulative and instantaneous emissions, and the like. Depending on planning objectives at any time, the problem may be implemented flexibly to reduce fuel consumption subject to constraints on emissions and speed limits, or to reduce emissions, subject to constraints on fuel use and arrival time. It is also possible to implement, for example, a goal to reduce the total travel time without constraints on total emissions or fuel use where such relaxation of constraints would be permitted or required for the trip.

Throughout the document, example equations and objective functions are presented for reducing fuel consumption. These equations and functions are for illustration only as other equations and objective functions can be employed to reduce fuel consumption or to optimize other powered vehicle/vehicle system operating parameters.

Mathematically, the problem to be solved may be stated more precisely. The basic physics are expressed by:

$$\frac{dx}{dt} = v \quad \text{(Equation \#1)}$$

$$x(0) = 0.0 \quad \text{(Equation \#2)}$$

$$x(T_f) = D \quad \text{(Equation \#3)}$$

$$\frac{dv}{dt} = T_e(u, v) - G_a(x) - R(v) \quad \text{(Equation \#4)}$$

$$v(0) = 0.0 \quad \text{(Equation \#5)}$$

-continued $$v(T_f) = 0.0 \quad \text{(Equation \#6)}$$

where x is the position of the vehicle system, v is the velocity of the vehicle system, t is time or distance along a trip (e.g., in miles, miles per hour, and minutes or hours, as appropriate), and u is the notch (e.g., throttle) command input. Further, D denotes the distance to be traveled; $T_f$ the desired arrival time at distance D along the route; $T_e$ is the tractive effort produced by the vehicle system; $G_a$ is the gravitational drag which depends on the size (e.g., length) of the vehicle system, makeup of the vehicle system, and/or terrain on which the vehicle system is located; and R is the net speed dependent drag of the consist and vehicle system combination. The initial and final speeds can also be specified, but without loss of generality are taken to be zero here (e.g., representing the vehicle system being stopped at the beginning and end of the trip). Finally, the model (e.g., of movement of the vehicle system, as represented by the equations above) can be readily modified to include other dynamics such the time lag between a change in throttle, u, and the resulting actual tractive effort or braking. Using this model, a control formulation is established to reduce (e.g., minimize) the quantitative objective function subject to constraints including but not limited to, speed limits and upper and/or lower limits on power (e.g., throttle) settings. Depending on planning objectives at any time, the problem may be set up flexibly to reduce (e.g., minimize) fuel consumed subject to constraints on emissions and speed limits, or to reduce (e.g., minimize) emissions, subject to constraints on fuel use and arrival time.

A goal to reduce (e.g., minimize) the total travel time without constraints on total emissions or fuel use may be implemented, where such relaxation of constraints would be permitted or required for the trip. These performance measures can be expressed as a linear combination of one or more of the following:

(Equation #7, e.g., to reduce or minimize total fuel consumption)

$$\min_{u(t)} \int_0^{T_f} F(u(t))\,dt$$

(Equation #8, e.g., to reduce or minimize travel time $$\min_{u(t)} T_f$$

(Equation #9, e.g., to reduce or minimize notch jockeying with piecewise constant input)

$$\min_{u_i} \sum_{i=2}^{n_d} (u_i - u_{i-1})^2$$

(Equation #10, e.g., to reduce or minimize notch jockeying with continuous input)

$$\min_{u(t)} \int_0^{T_f} \left(\frac{du}{dt}\right)^2 dt$$

The fuel term F in Equation #7 with a term corresponding to emissions production can be replaced. For example, for emissions as a performance measure, the following may be used in the linear combination:

(Equation #11, e.g., to reduce or minimize total emissions production)

$$\min_{u(t)} \int_0^{T_f} E(u(t))\,dt$$

In Equation #11, E is the quantity of emissions in gm/hphr for each of the notches (or power settings). Additionally, a reduction could be performed based on a weighted total combination of fuel and emissions.

One representative objective function is thus:

(Equation #12, also referred to as *OP*)

$$\min_{u(t)} \alpha_1 \int_0^{T_f} F(u(t))dt + \alpha_3 T_f + \alpha_2 \int_0^{T_f} \left(\frac{du}{dt}\right)^2 dt$$

The coefficients of the linear combination depend on the importance (weight) given to each of the terms. Note that in Equation (OP), u(t) is the optimizing variable that is the continuous notch position. If discrete notch is required, e.g. for older vehicles, the solution to Equation (OP) can be discretized, which may result in lower fuel savings. Finding a reduced time solution (e.g., $\alpha_1$ set to zero and $\alpha_2$ set to zero or a relatively small value) is used to find a lower bound for the achievable travel time (e.g., $T_f = T_{fmin}$). In this case, both u(t) and $T_f$ are optimizing variables. In one embodiment, the Equation (OP) is solved for various values of $T_f$ with $T_f > T_{fmin}$ with $\alpha_3$ set to zero. In this latter case, $T_f$ is treated as a constraint.

For those familiar with solutions to such optimal problems, it may be necessary to adjoin constraints, e.g. the speed limits along the path:

$$0 \le v \le SL(x) \quad \text{(Equation \#13)}$$

or when using reduced travel time as the objective, that an end point constraint is held, e.g., that total fuel consumed be less than what is in the tank of the vehicle, e.g., via:

$$\text{i. } 0 < \int_0^{T_f} F(u(t))\,dt \le W_F \quad \text{(Equation \#14)}$$

where $W_F$ is the fuel remaining in the tank at $T_f$. Equation (OP) can be in other forms as well and what is presented above is an exemplary equation for use in one embodiment of the inventive subject matter. For example, a variation of Equation (OP) can be used where multiple power systems, diesel and/or non-diesel, are used to provide multiple thrusters, such as but not limited to those that may be used when operating a marine vessel.

Reference to emissions in the context of one or more embodiments of the inventive subject matter can be directed toward cumulative emissions produced in the form of oxides of nitrogen (NOx), carbon oxides ($CO_x$), unburned hydrocarbons (HC), and particulate matter (PM), etc. However, other emissions may include, but not be limited to an upper limit on the value of electromagnetic emission, such as a limit on radio frequency (RF) power output, measured in watts, for respective frequencies emitted by the vehicle system or powered vehicle. Yet another form of emission is the noise produced by the powered vehicle or vehicle system, typically measured in decibels (dB). An emission requirement may be variable based on a time of day, a time of year, and/or atmospheric conditions such as weather or pollutant level in the atmosphere. Emission regulations may vary geographically across a route system, such as a railroad system. For example, an operating area such as a city or state may have specified emission objectives, and an adjacent area may have different emission objectives, for example a lower amount of allowed emissions or a higher fee charged for a given level of emissions.

Accordingly, a trip plan for a certain geographic area may be tailored to include upper limit emission values for each of the regulated emissions included in the trip plan to meet a predetermined emission objective required for that area. Typically, for a powered vehicle, these emission parameters are determined by, but not limited to, the power (e.g., notch) setting, ambient conditions, engine control method, etc. By design, the powered vehicles may be required to be compliant with EPA emission standards, and thus in an embodiment of the inventive subject matter that reduces emissions, this may refer to trip-total emissions for which there is no current EPA specification. Operation of the vehicle system according to the trip plan can be at all times compliant with EPA emission standards. Because diesel engines are used in other applications, other regulations may also be applicable. For example, $CO_2$ emissions are considered in certain international treaties.

If an objective during a trip is to reduce emissions, the optimal control formulation, Equation (OP), can be amended to consider this trip objective. One or more of the trip objectives can vary by geographic region or trip. For example, for a high priority vehicle system, a designated travel time may be the only objective on one route because the vehicle system is high priority traffic. In another example, emission output could vary from state to state along the planned trip route.

To solve the resulting optimization problem, in an embodiment the inventive subject matter transcribes a dynamic optimal control problem in the time domain to an equivalent static mathematical programming problem with N decision variables, where the number N depends on the frequency at which throttle and braking adjustments are made and the duration of the trip. For typical problems, this N can be in the thousands. For example, in an embodiment, suppose a train is traveling a 172-mile (276.8 kilometers) stretch of track in the southwest United States. Utilizing one embodiment of the inventive subject matter, an exemplary 7.6% saving in fuel used may be realized when using a trip determined and followed using one embodiment of the inventive subject matter versus an actual driver throttle/speed history where the trip was determined by an operator. The improved savings is realized because the optimization realized by using the embodiment of the inventive subject matter produces a driving strategy with both less drag loss and little or no braking loss compared to the manual trip plan of the operator.

Figure 2:
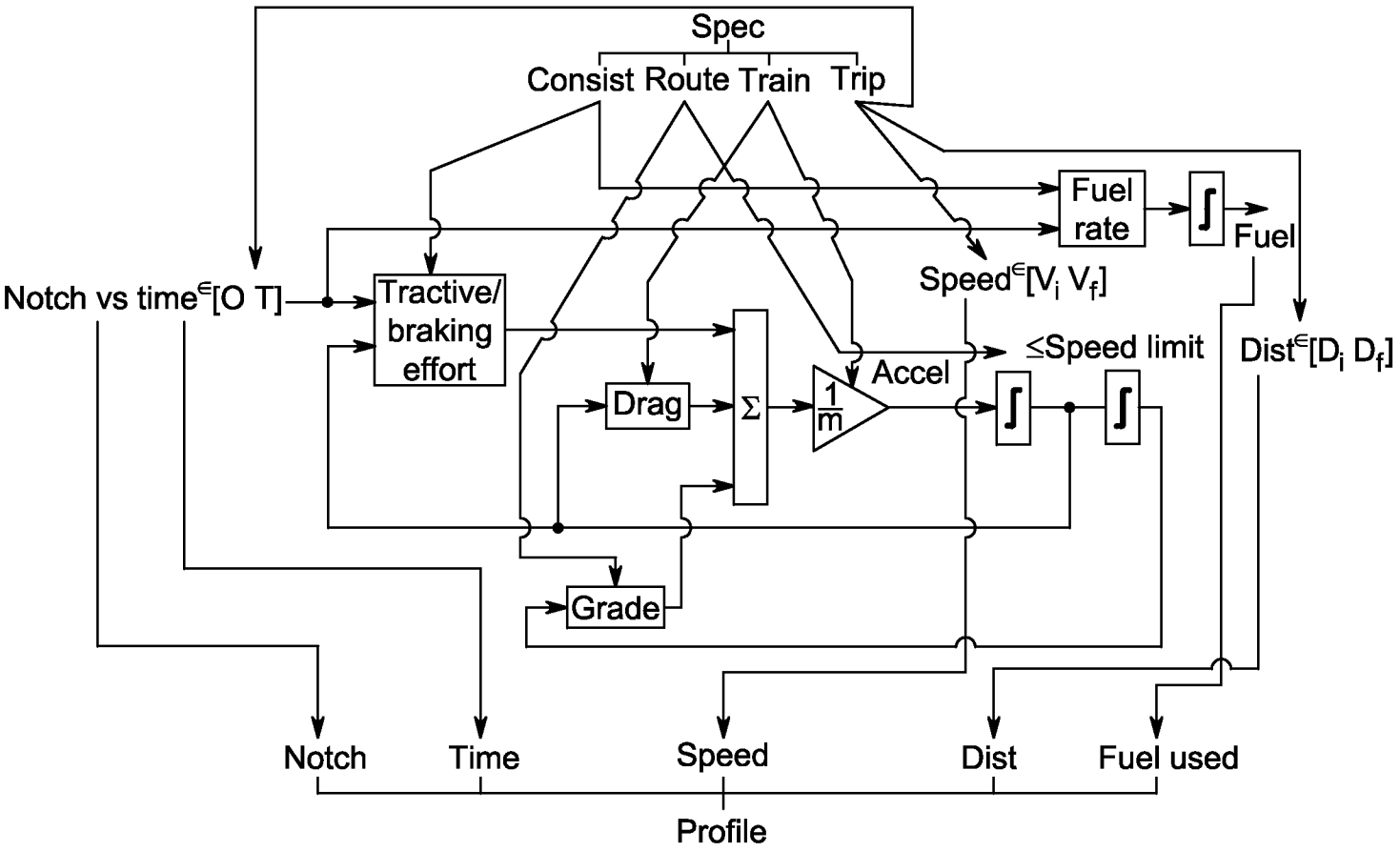
FIG. 2 depicts a mathematical model of a powered system that may be employed in connection with one embodiment.

To make the optimization described above computationally tractable, a simplified mathematical model of the vehicle system may be employed, such as illustrated in FIG. 2 and the equations discussed above. As illustrated, certain set specifications, such as but not limited to information about the consist, route information, vehicle system information, and/or trip information, are considered to determine a trip plan, such as an optimized trip plan. Such factors included in the trip plan include, but are not limited to, speed, distance remaining in the trip, and/or fuel used. As disclosed herein, other factors that may be included in the trip plan are notch setting and time. One possible refinement to the trip plan is produced by driving a more detailed model with the power sequence generated, to test if other thermal, electrical, and mechanical constraints are violated. This leads to a modified profile with speed versus distance that is closest to a run that can be achieved without harming powered vehicles or vehicle system equipment (e.g., satisfying additional implied constraints such as thermal and electrical limits on the powered vehicle and inter-car forces in the vehicle system). The equations discussed herein can be utilized with FIG. 2.

Referring back to FIG. 1, once the trip is started, power commands are generated 14 to put the trip plan in motion. Depending on the operational set-up of the embodiment of the inventive subject matter being used, one command is for the powered vehicle to follow a power command 16 of the trip plan so as to achieve a designated speed. The embodiment can obtain actual speed and power information from the consist of the vehicle system 31. Owing to the inevitable approximations in the models used for the optimization, a closed-loop calculation of corrections to optimized power is obtained to track the desired optimal speed. Such corrections of operating limits can be made automatically or by the operator.

In some cases, the model used in the optimization may differ significantly from the actual vehicle system. This can occur for many reasons, including but not limited to, extra cargo pickups or setouts, powered vehicles that fail during travel, and errors in the initial database 63 or data entry by the operator. For these reasons, a monitoring system can use real-time vehicle system data to estimate powered vehicle and/or train parameters in real time 20. The estimated parameters are then compared to the assumed parameters used when the trip plan was initially created 22. Based on differences in the assumed and estimated values, the trip plan may be re-planned 24, should large enough savings accrue from a new plan.

Other reasons a trip plan may be revised include directives from a remote location, such as dispatch, and/or the operator requesting a change in objectives to be consistent with more global movement planning objectives. Additional global movement planning objectives may include, but are not limited to, the schedules of other vehicles or vehicle systems, allowing exhaust to dissipate from a tunnel, maintenance operations, etc. Another reason may be due to an onboard failure of a component. Strategies for re-planning may be grouped into incremental and major adjustments depending on the severity of the disruption, as discussed in more detail below. In general, a "new" plan must be derived from a solution to the optimization problem Equation (OP) described above, but frequently faster approximate solutions can be found, as described herein.

Figure 4:
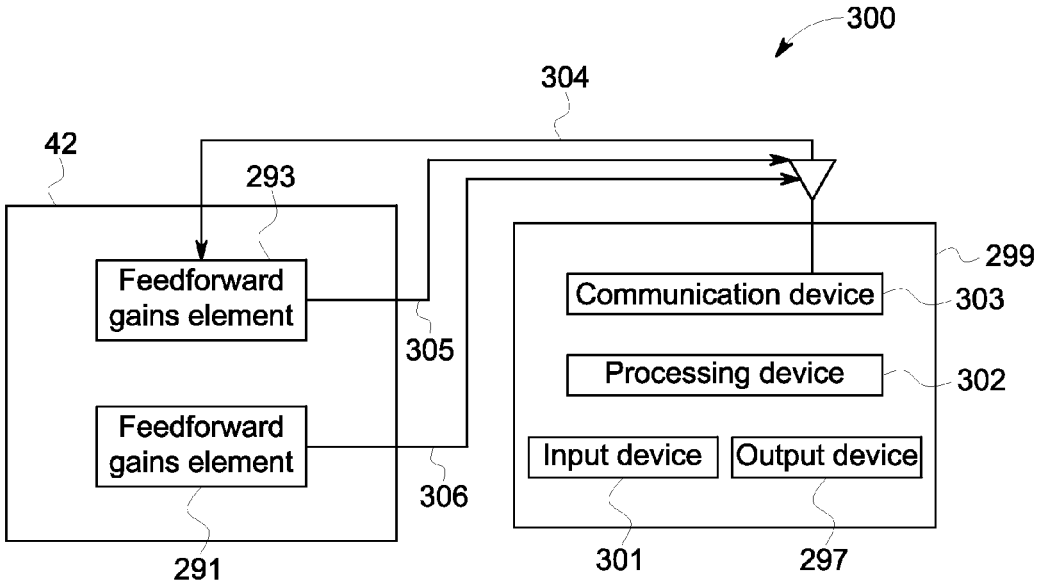
FIG. 4 depicts a diagram illustrating an embodiment of a closed loop system for remotely controlling a powered system.

In operation, the powered vehicle 42 can repeatedly monitor system efficiency and repeatedly update the trip plan based on the actual efficiency measured, such as when such an update would improve trip performance. Re-planning computations may be carried out entirely within the powered vehicle(s) or fully or partially moved to a remote location, such as dispatch or wayside processing facilities where wireless technology is used to communicate the plans to the powered vehicle(s) 42. One embodiment of the inventive subject matter may also generate efficiency trends that can be used to develop vehicle fleet data regarding efficiency transfer functions. The fleet-wide data may be used when determining the initial trip plan, and may be used for network-wide optimization tradeoff when considering locations of a plurality of vehicle systems. For example, the travel-time fuel use tradeoff curve as illustrated in FIG. 4 reflects a capability of a train on a particular route at a current time, updated from ensemble averages collected for many similar trains on the same route. Thus, a central dispatch facility collecting curves like FIG. 4 from many locomotives could use that information to better coordinate overall train movements to achieve a system-wide advantage in fuel use or throughput. As disclosed above, various fuel types, such as but not limited to diesel fuel, heavy marine fuels, palm oil, bio-diesel, etc., may be used.

Furthermore, as disclosed above, various energy storage devices may be used. For example, the amount of power withdrawn from a particular source, such as a diesel engine and batteries, could be optimized so that the fuel consumed and/or emissions generated, which may be an objective function, is reduced. As further illustration, suppose the total power demand is 2000 horse power (HP), where the batteries can supply 1500 HP and the engine can supply 4400 HP, the optimum point could be when batteries are supplying 1200 HP and engine is supplying 200 HP.

Similarly, the amount of power may also be based on the amount of energy stored and the need for the energy in the future. For example, if there is a long high demand coming for power, the battery could be discharged at a slower rate. For example, if 1000 horsepower hour (HPhr) is stored in the battery and the demand is 4400 HP for the next 2 hours, a trip plan may direct the battery to discharge at 800 HP for the next 1.25 hours and then use 3600 HP from the engine for the duration.

Many events in daily operations can lead to a need to generate or modify a currently executing plan, where it desired to keep the same trip objectives, for example when a first vehicle system is not on schedule for planned meet or pass with a second vehicle system and the first vehicle system needs to make up time. Using the actual speed, power and location of the first vehicle system, a comparison can be made between a planned arrival time and the currently estimated (e.g., predicted) arrival time 25. Based on a difference in the times, as well as the difference in parameters (detected or changed by dispatch or the operator), the trip plan can be adjusted 26. This adjustment may be made automatically according to a desire (e.g., designated rules) for how such departures from trip plan should be handled, or alternatives may be manually proposed for the on-board operator and dispatcher to jointly decide the best way to get back on trip plan. Whenever a trip plan is updated but where the original objectives (such as but not limited to arrival time) remain the same, additional changes may be factored in concurrently, e.g., new future speed limit changes, which could affect the feasibility of ever recovering the original plan. In such instances, if the original trip plan cannot be maintained, or in other words the vehicle system is unable to meet the original trip plan objectives, as discussed herein other trip plan(s) may be presented to the operator and/or remote facility, or dispatch.

A re-plan may also be made when it is desired to change the original objectives. Such re-planning can be done at either fixed preplanned times, manually at the discretion of the operator or dispatcher, or autonomously when predefined limits, such as operating limits of the vehicle system, are exceeded. For example, if the current plan execution is running late by more than a specified threshold, such as thirty minutes, one embodiment of the inventive subject matter can revise the trip plan to accommodate the delay at the expense of increased fuel use, as described above, or to alert the operator and dispatcher how much of the time can be made up at all (e.g., what minimum time to go or the maximum fuel that can be saved within a time constraint). Other triggers for re-plan can also be envisioned based on fuel consumed or the health of the consist, including but not limited time of arrival, loss of horsepower due to equipment failure and/or equipment temporary malfunction (such as operating too hot or too cold), and/or detection of gross setup errors, such as in the assumed vehicle load. If the change reflects impairment in the powered vehicle performance for the current trip, these may be factored into the models and/or equations used in the revising or formulation of the trip plan.

Changes in plan objectives can also arise from a need to coordinate events where the plan for one vehicle system compromises the ability of another vehicle system to meet objectives and arbitration at a different level, e.g. the dispatch office is required. For example, the coordination of meets and passes may be further optimized through train-to-train communications. Thus, as an example, if a first vehicle system knows that it is behind schedule in reaching a location for a meet and/or pass, communications from a second vehicle system can notify the first vehicle system (and/or dispatch). The operator can then enter information pertaining to being late into a trip planning system (described below), wherein the trip planning system will recalculate the trip plan. One embodiment of the trip planning system can also be used at a high level, or network level, to allow a dispatch to determine which vehicle system should slow down or speed up should a scheduled meet and/or pass time constraint may not be met. As discussed herein, this can be accomplished by transmitting data from the vehicle systems to the dispatch to prioritize how each vehicle system should change an associated planning objective. A choice could be based on either schedule or fuel saving benefits, depending on the situation.

Figure 5:
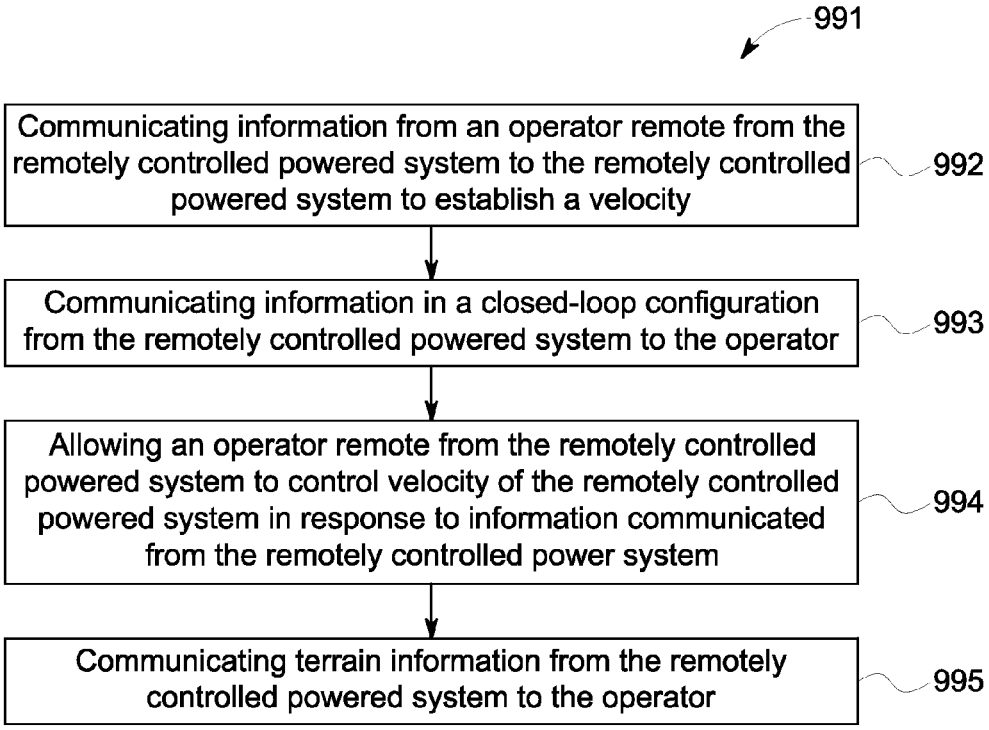
FIG. 5 depicts a flowchart illustrating an embodiment for operating a remotely controlled powered system.

More than one trip plan can be determined and presented to the operator of a vehicle system. In one embodiment, several different trip plans are presented to the operator, allowing the operator to select the arrival time and understand the corresponding fuel and/or emission impact from examination of the several trip plans. Such information can also be provided to the dispatch for similar consideration, either as a simple list of alternatives or as a plurality of tradeoff curves such as illustrated in FIG. 5.

One embodiment of the inventive subject matter has the ability to learn and adapt to changes in the vehicle system and consist which can be incorporated either in the current trip plan and/or in future trip plans. For example, one of the triggers discussed above is loss of horsepower. When building up horsepower over time, either after a loss of horsepower or when beginning a trip, transition logic can be utilized to determine when desired horsepower is achieved. This information can be saved in a database 61 for use in determining trip plans for future trips and/or the current trip (should loss of horsepower occur again in the current trip).

Likewise, in a similar fashion where multiple thrusters are available, each thruster may need to be independently controlled. For example, a marine vessel may have many force producing elements, or thrusters, such as but not limited to propellers. Each propeller may need to be independently controlled to produce the output designated by a trip plan. Therefore, utilizing transition logic, the trip optimizer may determine which propeller to operate based on what has been learned previously and by adapting to key changes in operation of the marine vessel.

Figure 3:
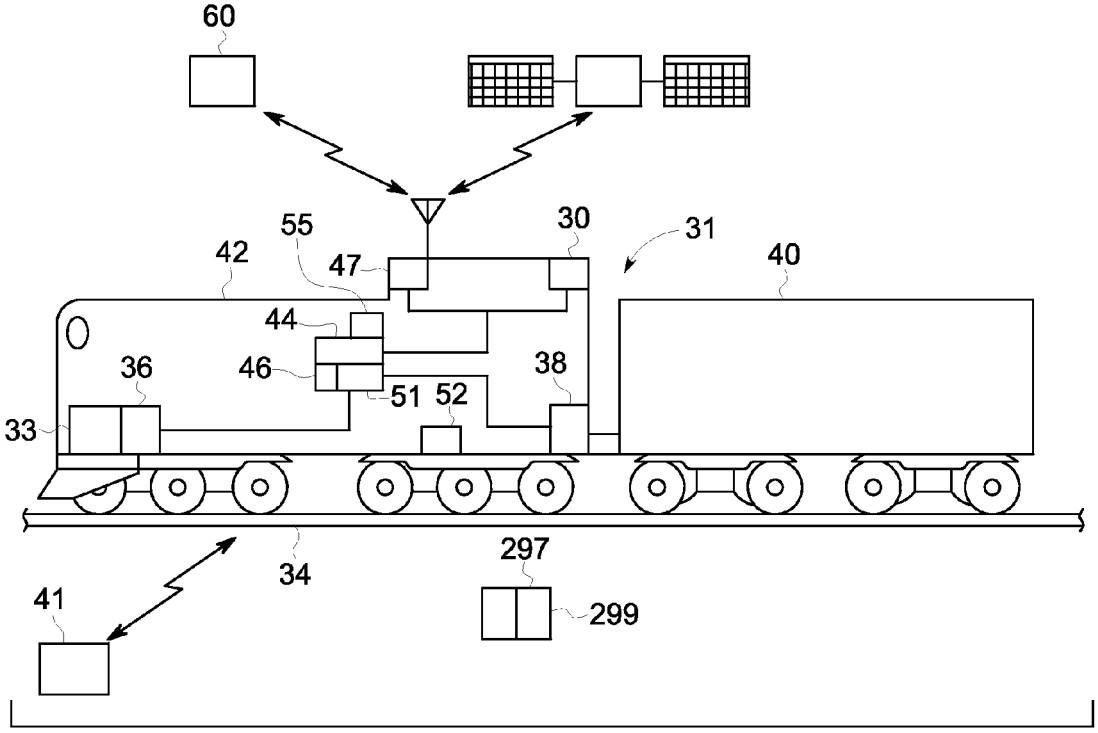
FIG. 3 depicts an embodiment of elements of a trip planning system.

FIG. 3 depicts various elements that may be part of a trip planning system, according to an embodiment of the inventive subject matter. A locator element 30 determines a location of the vehicle system 31. The locator element 30 can be a Global Positioning System (GPS) sensor (e.g., receiver), or a system of sensors, that determines the location of the vehicle system 31. Examples of such other systems may include, but are not limited to, wayside devices, such as radio frequency automatic equipment identification (RF AEI) tags, dispatch, and/or video determination. Another system may include the tachometer(s) onboard the vehicle system and distance calculations from a reference point. A wireless communication system 47 may also be provided to allow for communications between vehicle systems and/or with a remote location, such as dispatch. Information about travel locations may also be transferred from other vehicle systems.

A route characterization element 33 provides terrain information about the terrain of the route or over which the route extends. This terrain information can include, but is not limited to, grade, elevation, curvature, and friction coefficients (e.g., adhesion). The route characterization element 33 may include an on-board route integrity database 36. Sensors 38 are used to measure a tractive effort 40 being hauled by the powered vehicle 42 or consist, throttle setting of the powered vehicle 42 or consist, powered vehicle 42 or consist configuration information, speed of the powered vehicle 42 or consist, individual powered vehicle configuration, individual powered vehicle capability, and the like. In one embodiment, the configuration information of the powered vehicle 42 or consist may be loaded without the use of a sensor 38, but is input in another manner as discussed above. Furthermore, the health of the powered vehicles 42 in the consist may also be considered. For example, if one powered vehicle 42 in the consist is unable to operate above power notch level 5, this information is used when creating or revising the trip plan.

Information from the locator element may also be used to determine an appropriate arrival time of the vehicle system 31. For example, if there is a first vehicle system 31 moving along a route 34 (e.g., a track) toward a destination, no other vehicle system is following behind the first vehicle system, and the first vehicle system 31 has no fixed arrival deadline to adhere to, the locator element, including but not limited to RF AEI tags, dispatch, and/or video determination, may be used to gage the exact location of the first vehicle system 31. Furthermore, inputs from these signaling systems may be used to adjust the speed of the vehicle system. Using the on-board track database, discussed below, and the locator element, such as GPS, the trip planning system can adjust an operator interface (e.g., display) to reflect the signaling system state at the given location of the vehicle system. In a situation where signal states would indicate restrictive speeds ahead, the trip planning system may elect to slow the vehicle system to conserve fuel.

Information from the locator element 30 may also be used to change planning objectives as a function of distance to destination. For example, owing to inevitable uncertainties about congestion along the route, "faster" time objectives on the early part of a route may be employed as a hedge against delays that statistically occur later. If it happens on a particular trip that delays do not occur, the objectives on a latter part of the journey can be modified to exploit the built-in slack time that was banked earlier, and thereby recover some fuel efficiency. A similar strategy could be invoked with respect to emissions restrictive objectives, e.g., approaching an urban area.

As an example of the hedging strategy, if a trip is planned from New York to Chicago, the system may have an option to operate a train slower at either the beginning of the trip or at the middle of the trip or at the end of the trip. The trip planning system can create or modify the trip plan to allow for slower operation at the end of the trip since unknown constraints, such as but not limited to weather conditions, track maintenance, etc., may develop and become known during the trip. As another consideration, if traditionally congested areas are known, the plan is developed with an option to have more flexibility around these traditionally congested regions. Therefore, the trip planning system may also consider weighting/penalty as a function of time/distance into the future and/or based on known/past experience. Such planning and re-planning can take weather conditions, track conditions, other trains on the track, etc., into consideration at any time during the trip so that the trip plan is adjusted accordingly.

FIG. 3 further discloses other elements that may be part of one embodiment of the trip planning system. A processor 44 receives information from the locator element 30, track characterizing element 33, and sensors 38. An algorithm 46 operates within the processor 44. The algorithm 46 can represent one or more sets of instructions (e.g., computer software modules or codes) stored on a tangible and non-transitory computer readable medium (e.g., a computer memory). The algorithm 46 is used by the processor 44 (e.g., the algorithm 46 directs the processor 44) to compute a trip plan based on parameters involving the powered vehicle 42, vehicle system 31, route 34, and objectives of the trip, as described above. Additional information (such as trip manifest data) also can be provided and may be retained in a database, such as but not limited to the database 36. In one embodiment, the trip plan is established based on models for behavior of the vehicle system as the vehicle system 31 moves along the route 34 as a solution of non-linear differential equations derived from physics with simplifying assumptions that are provided in the algorithm. The algorithm 46 has access to the information from the locator element 30, track characterizing element 33, and/or sensors 38 to create the trip plan that reduces fuel consumption and/or emissions of the powered vehicle 42 and/or consist, establishes a desired trip time, and/or ensures proper crew operating time aboard the powered vehicle 42 and/or consist. In one embodiment, a driver or operator, and/or controller element, 51 is also provided. The controller element 51 is used for controlling the vehicle system as the vehicle system follows the trip plan. In one embodiment discussed further herein, the controller element 51 makes operating decisions autonomously. In another embodiment, the operator may be involved with directing the vehicle system to follow the trip plan.

A feature of one embodiment of the inventive subject matter is the ability to initially create and quickly modify "on the fly" any trip plan that is being executed. This includes creating the initial trip plan when a long distance is involved, owing to the complexity of the plan optimization algorithm 46. When a total length of a trip profile exceeds a given distance, the algorithm 46 may be used to segment the mission, wherein the mission may be divided by waypoints. Though only a single algorithm 46 is discussed, more than one algorithm may be used (or that the same algorithm may be executed a plurality of times), wherein the algorithms may be connected together. The waypoint may include natural locations where the vehicle system 31 stops, such as, but not limited to, sidings where a meet with opposing traffic (or pass with a train behind the current train) is scheduled to occur on a single-track rail, or at yard sidings or industry where cars are to be picked up and set out, and locations of planned work. At such waypoints, the vehicle system 31 may be required to be at the location at a scheduled time and be stopped or moving with speed in a specified range. The time duration from arrival to departure at waypoints is called "dwell time."

With respect to a remote controlled powered vehicle, such as but not limited to a remotely controlled locomotive (RCL), the elements disclosed in FIG. 3 may further be used to provide for speed regulation of the RCL. Specifically, terrain information, such as but not limited to information contained in the route database 36 may be used to optimize speed regulation. As disclosed, the information in the route database 36 may be obtain manually and/or automatically (e.g., such as but not limited to an AEI tag reader). Speed regulation is performed by commanding a speed regulator 55 aboard the RCL. The speed regulator 55 may receive an input signal, such as an input speed or a designated speed, and create a control signal. The control signal can be communicated to the controller element 51 to cause the controller element 51 to change throttle and/or brake settings and cause the powered vehicle 42 to travel at the speed that is input into the speed regulator 55. An operator control unit 299, is also disclosed.

FIG. 4 discloses a block diagram illustrating one embodiment of a feedforward element 293 and a feedback element 291 that are used to control the speed regulator. As illustrated, a closed-loop process 300 is disclosed. As described below, the process 300 can be used to receive an operator command to control the vehicle 42, to predict how the vehicle 42 will operate based on the command that is remotely received from the operator, and to provide feedback on actual operations of the vehicle 42 to the operator. Information, such as either a motoring command or a braking command, is remotely input to the powered vehicle 42 from the operator control unit 299. This information can be an operator command (e.g., a command that is generated or input by an operator of the control unit 299). One example of an operator command is an operator-selected speed at which the vehicle 42 or system 31 is to travel. Another example is an operator-selected location to which the vehicle 42 or system 31 is to travel within a designated or operator-selected time. For example, the operator can input a command into the control unit 299 that instructs the vehicle 42 or system 31 to travel 1,000 feet or meters within 2 minutes. Another example of an operator command is an operator-selected distance in which the vehicle 42 or system 31 is to stop within. For example, for a moving vehicle 42, the operator can direct the vehicle 42 to stop within the next 1,000 feet or meters using an operator command that is input into the control unit 299. Other operator commands alternatively or additionally may be used. Terrain information, as well as other operational information is provided from the feedback element 291 onboard the powered vehicle 42 back to the operator control unit 299. This operational information can represent actual operations of the vehicle 42 or system 31, such as an actual (e.g., current or previous) speed and/or acceleration of the vehicle 42 or system 31. Based on the information being relayed from the feedback element 291, the operator is able to use the operator control unit 299 to adjust, or regulate speed, of the powered vehicle 42.

The operator control unit 299 may include an output device 297, such as a display area, to display information, or feedback information, such as is disclosed below with respect to FIGS. 8-19B. The feedback information may be either visual, audible, alphanumeric, text based, and/or a combination of any of these examples.

FIG. 5 discloses a flowchart illustrating an embodiment for operating a remotely controlled powered system. As disclosed in the flowchart 991, information is communicated from an operator who is remote (e.g., off-board) from the remotely controlled powered system to the powered system, at 992. This information can include one or more of the operator commands described above. Information is communicated in a closed-loop configuration from the remotely controlled powered system to the operator, at 993. This information can include predictive information, such as a prediction of how the vehicle 42 or system 31 may operate based on the operator command that is input and the terrain information. The information may include reporting information, such as a reporting of an actual speed and/or acceleration at which the vehicle 42 and/or system 31 is currently traveling or previously traveled. The operator may remotely control the vehicle 42 in response to the information received, at 994. The information communicated to the operator may include terrain information, at 995. The flowchart 991 disclosed in FIG. 5 may also be implemented with a computer software code that operates within a processor and is storable on a computer readable media.

In one embodiment, the feedforward element 293 is a processing device (e.g., a processor, controller, or the like) disposed onboard the powered vehicle that obtains a selected speed of the powered vehicle 42. The operator control unit 299 can be disposed off-board the powered vehicle 42 to allow the operator having the operator control unit 299 to remotely control movement of the powered vehicle 42. The operator control unit 299 includes one or more input devices 301, such as one or more buttons, switches, touchscreens, knobs, or other actuators, that are used by an operator to input an operator command. As described above, the operator command can include a selected speed at which the powered vehicle 42 is to travel, a distance that the vehicle 42 is to travel within a time period, and/or a distance that the vehicle 42 is to stop within a time period.

The operator control unit 299 also includes a processing device 302, such as a processor, controller, and the like, that receives the selected speed from the input device 301. The processing device 302 can generate an output signal 304 that represents the operator command based on the actuation of the input device 301. The processing device 302 communicates the output signal to the powered vehicle 42 (e.g., to a wireless communication device, such as an antenna and associated circuitry, of the powered vehicle 42) via a communication device 303 so that the feedforward element 293 can receive the operator command. The communication device 303 can represent an antenna and associated circuitry that can wirelessly communicate with the powered vehicle 42.

Alternatively or additionally, the operator command may be obtained or derived from a trip plan of the powered vehicle 42. The trip plan can include designated speeds, power outputs, stops, locations, and the like, of the powered vehicle 42, as described above.

The feedforward element 293 receives the output signal 304 that is indicative of the operator command from the operator control unit 299. For example, the feedforward element 293 may be connected with a wireless communication system of the powered vehicle for receiving the output signal 304 from the communication device 303 of the operator control unit 299. The feedback element 291 can be a processing device (e.g., a processor, controller, or the like) that is separate from the feedforward element 293 and that is disposed onboard the powered vehicle 42. Alternatively, the feedback element 291 can be the same processing device as the feedforward element 293.

The feedforward element 293 uses the operator command along with terrain information of an upcoming segment of the route being traveled by the powered vehicle 42 in order to predict operations of the vehicle 42. The predicted operations can include predicted throttle settings of the vehicle 42 that may be necessary to cause the vehicle 42 to travel according to the operator command over an upcoming segment of the route. For example, the predicted operations from the feedforward element 293 can include designated throttle settings that should be used such that the vehicle 42 travels at or within a designated range of the selected speed. As described below, the predicted operations can be provided in a power or throttle setting (e.g., notch) profile with the power or throttle settings that are predicted to be needed to cause the vehicle 42 to travel according to the operator command expressed as a function of distance over the upcoming segment of the route. The predicted operations also or alternatively can include predicted speeds at which the vehicle 42 or system 31 will travel if the operator command is implemented. For example, if the operator command is a throttle setting, then the predicted operations from the feedforward element 293 can be a profile of the predicted speed at which the vehicle 42 will travel over the upcoming segment of the route (expressed as a function of distance) if the operator-selected throttle setting is used to control the vehicle 42. The predicted operations can be at least partially based on terrain information of the upcoming segment of the route. For example, the feedforward element 293 may be communicatively coupled with the route database 36 onboard the vehicle 42 so that the feedforward element 293 can obtain terrain information for an upcoming segment of the route.

The feedforward element 293 can examine the operator command and the terrain information to determine the predicted operations. With respect to predicting the throttle settings that are needed to cause the vehicle 42 or system 31 to travel at an operator-selected speed, the feedforward element 293 may predict that greater notch settings (e.g., greater tractive effort and/or power output) may be needed to cause the vehicle 42 to travel at the selected speed over uphill grades, but lesser notch settings (e.g., less tractive effort and/or power output) are needed to cause the vehicle 42 to travel at the selected speed over downhill grades. The feedforward element 293 may predict the designated throttle settings based on vehicle information, such as the size (e.g., length and/or mass) of the vehicle system 31, the current speed and/or inertia of the vehicle system 31, the power output capability of the vehicle system 31, and the like. For example, for smaller vehicle systems 31, faster moving vehicle systems 31, and/or vehicle systems 31 having greater inertia and/or power output capabilities, the feedforward element 293 may select a smaller designated throttle setting to achieve a selected speed when compared to larger vehicle systems 31, slower moving vehicle systems 31, and/or vehicle systems 31 having lesser inertia and/or power output capabilities.

Figure 22:
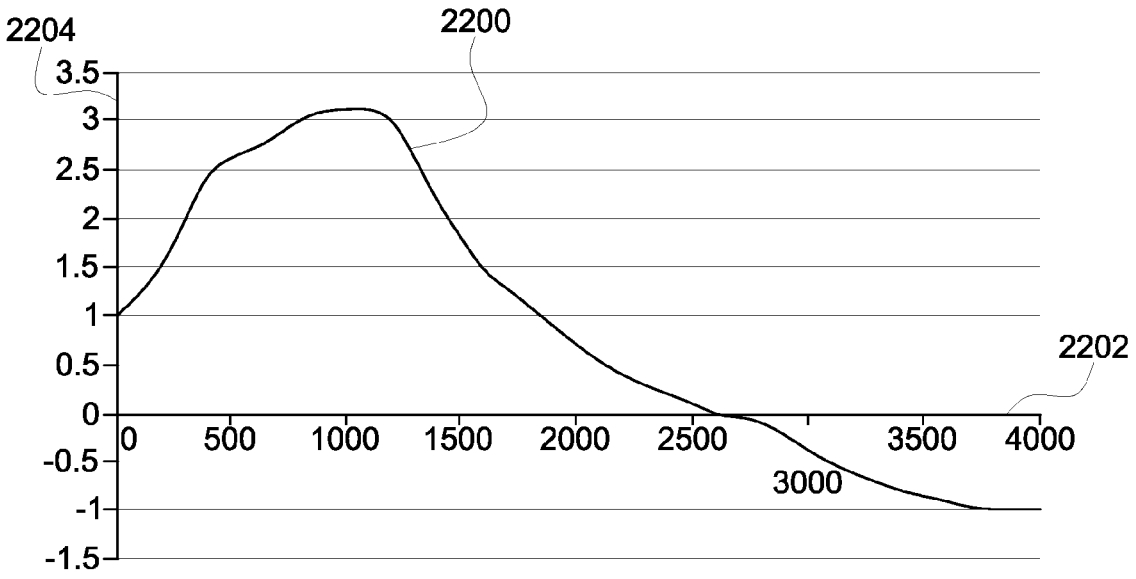
FIG. 22 illustrates one example of a throttle profile that is predicted by the feedforward element shown in FIG. 4 in order to cause the vehicle or vehicle system to travel at an operator-selected speed over an upcoming segment of a route.

FIG. 22 illustrates one example of a throttle profile 2200 that is predicted by the feedforward element 293 in order to cause the vehicle 42 or system 31 to travel at an operator-selected speed over an upcoming segment of a route. The throttle profile 2200 is shown alongside a horizontal axis 2202 that represents distance, such as a distance from a current location of the powered vehicle 42 or system 31. Alternatively, the horizontal axis 2202 may represent time from a current time. The throttle profile 2200 also is shown alongside a vertical axis 2204 that represents predicted throttle settings of the powered vehicle 42, such as the notch settings of a locomotive that may need to be implemented when the vehicle 42 is at the corresponding location in order to cause the vehicle 42 or system 31 to travel at the operator-selected speed. The increasing positive throttle settings represent increasing amounts of tractive effort and/or power generated by the powered vehicle 42. The increasingly negative throttle settings represent increasing amounts of braking effort applied by the powered vehicle 42.

The throttle profile 2200 can indicate which throttle settings may need to be used to cause the powered vehicle 42 to travel at the operator-selected speed over the upcoming segment of a route. For example, for a selected speed, the throttle setting needs to increase from a setting of one to a setting of three from a current location of the vehicle 42 to a location that is approximately 750 feet or meters away from the current location. This can represent an uphill grade in the upcoming segment of the route. From approximately 1100 feet or meters away and onward, the throttle setting may need to decrease (and eventually require application of brakes) in order to cause the vehicle 42 to maintain the operator selected speed. This can represent a subsequent downhill grade in the upcoming segment of the route.

Another example of predictive information that may be provided by the feedforward element 293 is predicted speeds at which the vehicle 42 may travel if an operator command (e.g., an operator-selected throttle setting) is implemented and maintained during travel over an upcoming segment of the route. This predictive information may be communicated to the operator as a speed profile of the vehicle 42 or system over the upcoming segment of the route.

Figure 23:
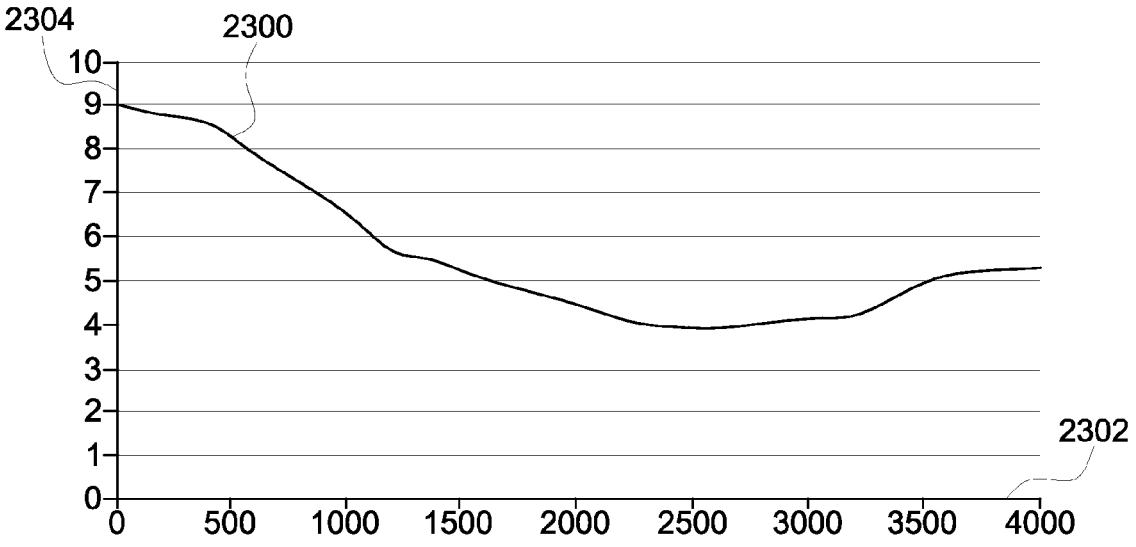
FIG. 23 illustrates one example of a speed profile that is predicted by the feedforward element shown in FIG. 4 based on an operator-selected throttle setting.

FIG. 23 illustrates one example of a speed profile 2300 that is predicted by the feedforward element 293 based on an operator-selected throttle setting. The speed profile 2300 is shown alongside a horizontal axis 2302 that represents distance, such as a distance from a current location of the powered vehicle 42 or system 31. Alternatively, the horizontal axis 2302 may represent time from a current time. The speed profile 2300 also is shown alongside a vertical axis 2304 that represents predicted speeds of the powered vehicle 42 or system 31, such as the speeds at which the vehicle 42 is predicted to travel based on the terrain of the upcoming segment of the route if the operator-selected throttle setting is maintained. For example, if the operator command is a notch setting of 2, then the speed profile 2300 may indicate that, if the powered vehicle 42 remains at notch 2 over the upcoming segment of the route represented by the horizontal axis 2302, then the vehicle 42 is predicted to travel at the speeds represented by the speed profile 2300.

In the illustrated example, if the operator-selected throttle setting is maintained, then the speed profile 2300 indicates that the vehicle 42 will slow down from a speed of nine (e.g., miles or kilometers per hour) to a speed of four from a current location to a location that is approximately 2100 meters or feet away. The vehicle 42 may then maintain an approximately constant speed until the vehicle 42 reaches a location that is approximately 3000 meters or feet away. At that location, maintaining the same throttle setting may cause the vehicle 42 to accelerate to a speed of approximately five for locations beyond 3000 meters or feet away from the current location. The projected speeds of the speed profile 2300 may result from an upcoming segment of a route that includes an uphill grade from a current location to a location that is approximately 2100 meters or feet away, followed by a flat terrain for the next approximately 1000 meters or feet, and followed by a downhill grade.

Returning to the discussion of FIG. 4, the feedforward element 293 communicates the predictive information (e.g., the throttle profile and/or speed profile) to the operator control unit 299 as a feedforward signal 305. The feedforward signal 305 can be wirelessly communicated to the operator control unit 299 and can include the designated throttle setting. The communication device 303 of the operator control unit 303 can receive the signal 305 and convey the signal 305 to the processing device 302. The processing device 302 can extract the throttle profile and/or speed profile from the signal 305 and present the throttle profile and/or speed profile to the operator of the operator control unit 299, such as by using the output device 297.

The feedback element 291 monitors actual operations of the powered vehicle 42 and communicates reporting information, such as actual speeds and/or accelerations of the vehicle 42 and/or system 31, to the operator control unit 299. The feedback element 291 may obtain the actual operations from one or more sensors, such as tachometers, Global Positioning System receivers, and the like.

Returning to the discussion of FIG. 4, the feedback element 291 can provide the reporting information to the operator control unit 299 as a feedback signal 306. The processing device 302 can direct the output device 297 to present the predictive information and/or the reporting information to the operator. For example, the output device 297 can display one or more profiles (e.g., throttle profiles and/or speed profiles) similar to the profiles 2200, 2300 shown in FIGS. 22 and 23 and/or actual speeds or accelerations of the vehicle 42. The operator may examine the predictive information and/or reporting information and determine or vary the operator command that is input into the operator control unit 299. For example, the operator may use the reporting information and predictive information in order to determine what throttle setting to input into the operator control unit 299. The operator may input an operator command, receive the predicted information and/or reporting information, and then change the operator command or use the operator command to control the vehicle 42 based on the predicted information and/or reporting information.

Figure 6:
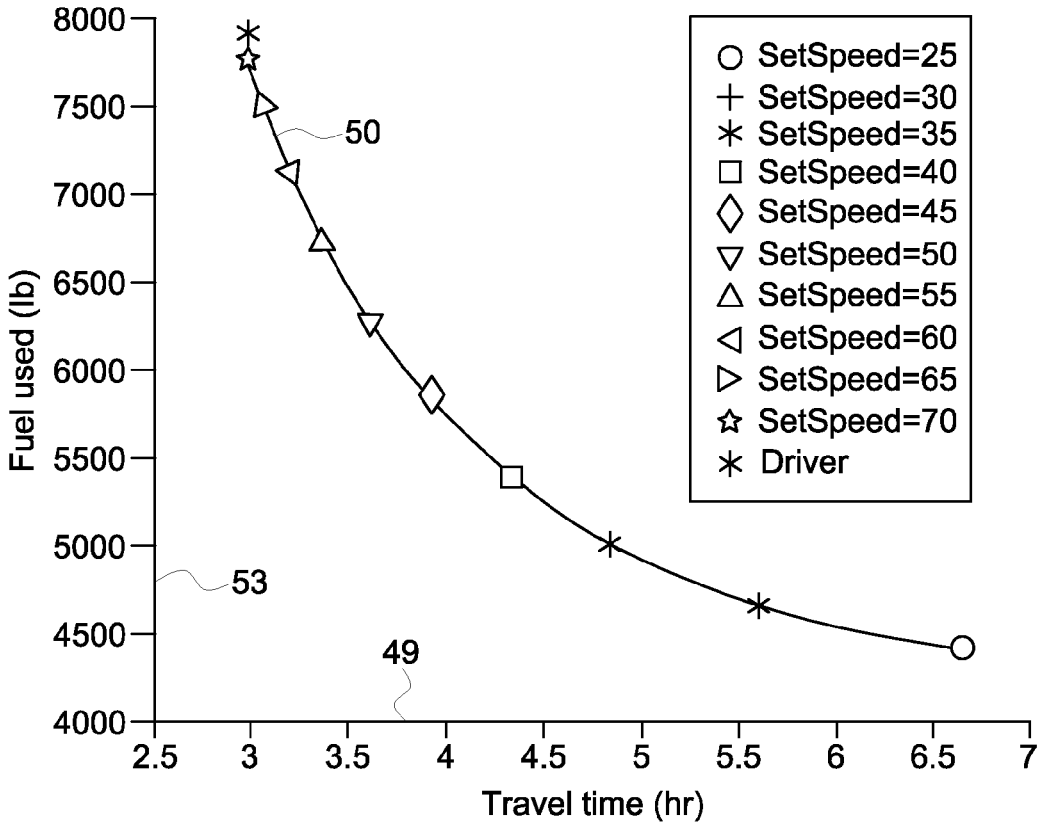
FIG. 6 depicts an embodiment of a fuel-use/travel time curve.
Figure 7:
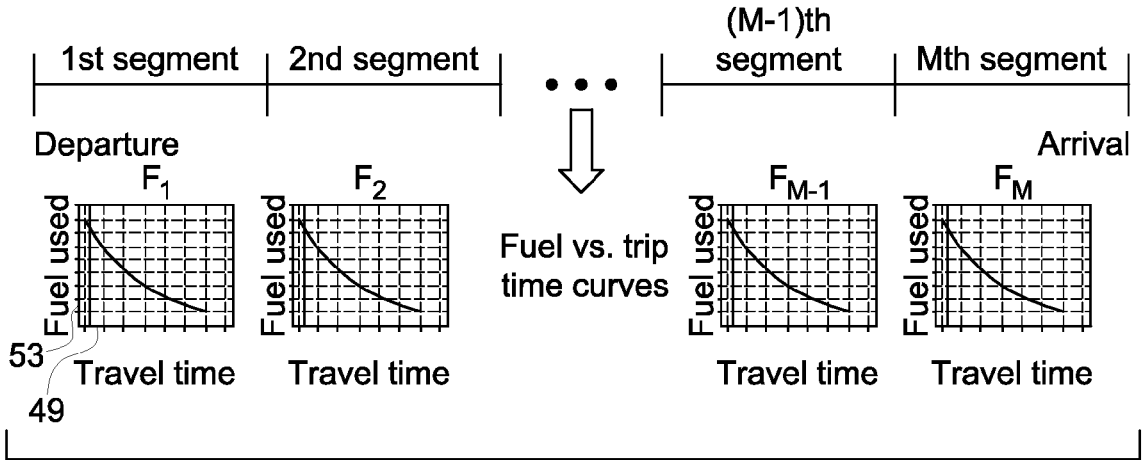
FIG. 7 depicts an embodiment of segmentation decomposition for trip planning.

Returning to the discussion of the trip planning system, in one embodiment, the trip planning system is able to break down a longer trip into smaller segments. Each segment can be somewhat arbitrary in length, but is typically picked at a natural location such as a stop or significant speed restriction, or at key mileposts that define junctions with other routes. Given a partition, or segment, selected in this way, a driving plan is created for each segment of route as a function of travel time taken as an independent variable, such as shown in FIG. 6. The fuel used/travel-time tradeoff associated with each segment can be computed prior to the vehicle system 31 reaching that segment of the route. A total trip plan can be created from the driving plans created for each segment. The trip planning system can distribute travel time amongst all the segments of the trip in an way so that a required or designated total trip time is satisfied and the total fuel consumed over all the segments is reduced relative to another plan (e.g., is as small as possible). An example three segment trip plan is shown in FIG. 7 and discussed below. Alternatively, the trip plan may comprise a single segment representing the complete trip.

FIG. 6 depicts an embodiment of a fuel-use/travel time curve 50. The curve 50 can represent one example of a trip plan. As mentioned previously, such a curve 50 can be created when calculating a trip plan for various travel times for each segment. That is, for a given travel time 49, fuel used 53 is the result of a driving plan computed as described above. Once travel times for each segment are allocated, a power/speed plan is determined for each segment from the previously computed solutions. If there are any waypoint constraints on speed between the segments, such as, but not limited to, a change in a speed limit, the constraints are matched up during creation of the trip plan. If speed restrictions change in only a single segment, the fuel use/travel-time curve 50 may be re-computed for only the segment changed. This reduces time for having to re-calculate more parts, or segments, of the trip. If the consist or vehicle system changes significantly along the route, e.g., from loss of a powered vehicle or pickup or set-out of cars, then driving profiles for all subsequent segments may be recomputed, thereby creating new instances of the curve 50. These new curves 50 would then be used along with new schedule objectives to plan the remaining trip.

Once a trip plan is created as discussed above, a trajectory of speed and power versus distance is used to reach a destination with reduced fuel use and/or emissions at the required trip time. There are several ways in which to execute the trip plan. As provided below in more detail, in one embodiment, when in an operator "coaching" mode, information is displayed to the operator for the operator to follow to achieve the required power and speed determined according to the trip plan. In this mode, the operating information includes suggested operating conditions that the operator should use. In another embodiment, acceleration and maintaining a constant speed are autonomously performed. When the vehicle system 31 is to be slowed, the operator can be responsible for applying a braking system 52. In another embodiment, commands for powering and braking are provided as required to follow the desired speed-distance path.

Feedback control strategies can be used to provide corrections to the power control sequence in the profile to correct for events such as, but not limited to, vehicle system load variations caused by fluctuating head winds and/or tail winds. Another such error may be caused by an error in vehicle system parameters, such as, but not limited to, mass and/or drag, when compared to assumptions in the trip plan. A third type of error may occur with information contained in the route database 36. Another possible error may involve unmodeled performance differences due to the engine, traction motor thermal duration, and/or other factors. Feedback control strategies compare the actual speed as a function of position to the speed in the trip plan. Based on this difference, a correction to the trip plan is added to drive the actual velocity toward the trip plan. To ensure stable regulation, a compensation algorithm may be provided which filters the feedback speeds into power corrections so that closed-performance stability is ensured. Compensation may include standard dynamic compensation as used in control system design to meet performance objectives.

One or more embodiments of the inventive subject matter allow the simplest and therefore fastest means to accommodate changes in trip objectives, which can be the rule, rather than the exception in railroad operations. In one embodiment, to determine the fuel-optimal trip from point A to point B where there are stops along the way, and for updating the trip for the remainder of the trip once the trip has begun, a suboptimal decomposition method is usable for finding a trip plan. Using modeling methods, the computation method can find the trip plan with specified travel time and initial and final speeds, so as to satisfy all the speed limits and vehicle capability constraints when there are stops. Though the following discussion is directed towards reducing fuel use, it can also be applied to optimize other factors, such as, but not limited to, emissions, schedule, crew comfort, and load impact. The method may be used at the outset in developing a trip plan, and more importantly to adapting to changes in objectives after initiating a trip.

Figure 8:
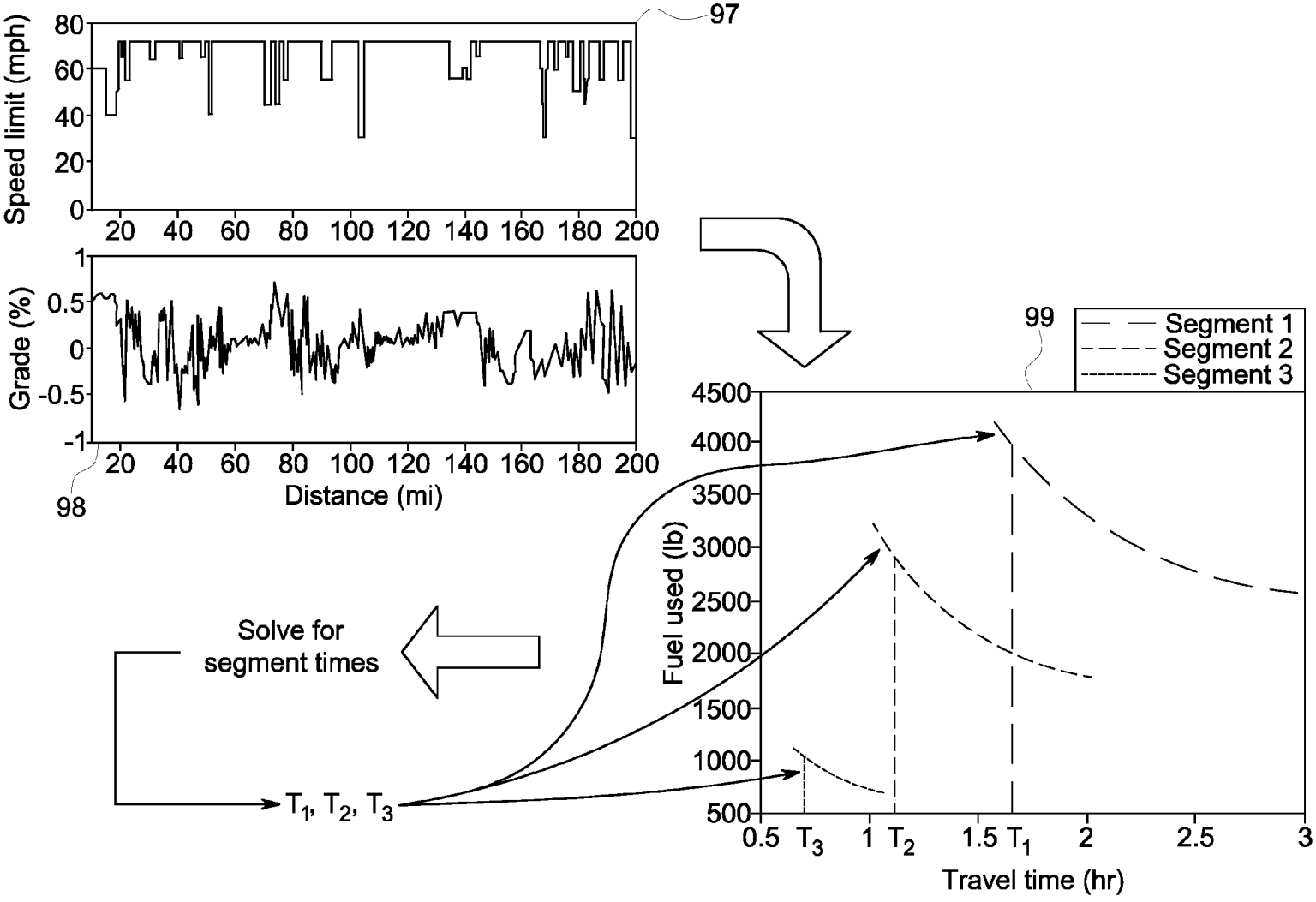
FIG. 8 depicts another embodiment of a segmentation decomposition for trip planning.

As discussed herein, one or more embodiments of the inventive subject matter may employ a setup as illustrated in the flow chart depicted in FIG. 7, and as a segment example depicted in detail in FIG. 8. As illustrated, the trip may be broken into two or more segments, T1, T2, and T3. (As noted above, it is possible to consider the trip as a single segment.) As discussed herein, the segment boundaries may not result in equal segments. Instead, the segments may use natural or mission specific boundaries. Trip plans are pre-computed for each segment. If fuel use versus trip time is the trip objective to be met, fuel versus trip time curves are built for each segment. As discussed herein, the curves may be based on other factors, wherein the factors are objectives to be met with a trip plan. When trip time is the parameter being determined, trip time for each segment is computed while satisfying the overall trip time constraints. FIG. 8 illustrates speed limits 97 for an exemplary segment, 200-mile (321.9 kilometers) trip. Further illustrated are grade changes 98 over the 200-mile (321.9 kilometers) trip. A combined chart 99 illustrating curves for each segment of the trip of fuel used over the travel time is also shown.

Using the control setup described previously, the present computation method can find the trip plan with specified travel time and initial and final speeds, so as to satisfy the speed limits and capability constraints of the vehicle system when there are stops. Though the following detailed discussion is directed towards reducing fuel use, it can also be applied to optimize other factors as discussed herein, such as, but not limited to, emissions. A key flexibility is to accommodate desired dwell time at stops and to consider constraints on earliest arrival and departure at a location as may be required, for example, in single-track operations where the time to be in or get by a siding is critical.

One or more embodiments of the inventive subject matter find a fuel-optimal trip plan from distance $D_0$ to $D_M$, traveled in time T, with M−1 intermediate stops at $D_1, \ldots, D_{M-1}$, and with the arrival and departure times at these stops constrained by:

$$t_{min}(i) \le t_{arr}(D_i) \le t_{max}(i) - \Delta t_i \quad \text{(Equation \#15)}$$

$$t_{arr}(D_i) + \Delta t_i \le t_{dep}(D_i) \le t_{max}(i) \quad \text{(Equation \#16)}$$

$$i = 1, \ldots, M-1 \quad \text{(Equation \#17)}$$

where $t_{arr}(D_i)$, $t_{dep}(D_i)$ and $\Delta t_i$ are the arrival, departure, and designated (e.g., lower or minimum) stop time at the $i^{th}$ stop, respectively. Assuming that fuel-optimality implies minimizing or reducing stop time, therefore $t_{dep}(D_i) = t_{arr}(D_i) + \Delta t_i$, which eliminates the second inequality above. Suppose for each i=1, . . . , M, the fuel-optimal trip plan from $D_{i-1}$ to $D_i$ for travel time t, $T_{min}(i) \le t \le T_{max}(i)$, is known. Let $F_i$ (t) be the fuel-use corresponding to this trip. If the travel time from $D_{j-1}$ to $D_j$ is denoted $T_j$, then the arrival time at $D_i$ is given by:

$$t_{arr}(D_i) = \sum_{j=1}^{i} (T_j + \Delta t_{j-1}) \quad \text{(Equation \#18)}$$

where $\Delta t_0$ is defined to be zero. The fuel-optimal trip plan from $D_0$ to $D_M$ for travel time T is then obtained by finding $T_i$, i=1, . . . , M, which minimize or reduce:

$$\sum_{i=1}^{M} F_i(T_i) \quad T_{min}(i) \le T_i \le T_{max}(i) \quad \text{(Equation \#19)}$$

subject to:

$$t_{min}(i) \le \sum_{j=1}^{i} (T_j + \Delta t_{j-1}) \le t_{max}(i) - \Delta t_i \quad \text{(Equation \#20)}$$

$$i = 1, \ldots, M-1$$

$$\sum_{j=1}^{M} (T_j + \Delta t_{j-1}) = T \quad \text{(Equation \#21)}$$

Once a trip is underway, the issue is re-determining the fuel-optimal solution for the remainder of a trip (originally from $D_0$ to $D_M$ in time T) as the trip is traveled, but where disturbances preclude following the fuel-optimal solution. Let the current distance and speed be x and v, respectively, where $D_{i-1} < x \le D_i$. Also, let the current time since the beginning of the trip be $t_{act}$. Then the fuel-optimal solution for the remainder of the trip from x to $D_M$, which retains the original arrival time at $D_M$, is obtained by finding $\tilde{T}_i$, $T_j$, j=i+1, . . . M, which minimize or reduce:

$$\tilde{F}_i(\tilde{T}_i, x, v) + \sum_{j=i+1}^{M} F_j(T_j) \quad \text{(Equation \#22)}$$

subject to:

$$t_{min}(i) \le t_{act} + \tilde{T}_i \le t_{max}(i) - \Delta t_i \quad \text{(Equation \#23)}$$

$$t_{min}(k) \le t_{act} + \tilde{T}_i + \sum_{j=i+1}^{k} (T_j + \Delta t_{j-1}) \le t_{max}(k) - \Delta t_k \quad \text{(Equation \#24)}$$

$$k = i+1, \ldots, M-1$$

$$t_{act} + \tilde{T}_i + \sum_{j=i+1}^{M} (T_j + \Delta t_{j-1}) = T \quad \text{(Equation \#25)}$$

Here, $\tilde{F}_i(t, x, v)$ is the fuel-used of the trip plan from x to $D_i$, traveled in time t, with initial speed at x of v.

As discussed above, one way to enable more efficient re-planning is to construct the optimal solution for a stop-to-stop trip from partitioned segments. For the trip from $D_{i-1}$ to $D_i$, with travel time $T_i$, choose a set of intermediate points $D_{ij}$, $j = N_i - 1$. Let $D_{i0} = D_{i-1}$ and $D_{iN_i} = D_i$. Then express the fuel-use for the trip plan from $D_{i-1}$ to $D_i$ as:

$$F_i(t) = \sum_{j=1}^{N_i} f_{ij}(t_{ij} - t_{i,j-1}, v_{i,j-1}, v_{ij}) \quad \text{(Equation \#26)}$$

where $f_{ij}(t, v_{i,j-1}, v_{ij})$ is the fuel-use for the trip plan from $D_{i,j-1}$ to $D_{ij}$, traveled in time t, with initial and final speeds of $v_{i,j-1}$ and $v_{ij}$. Furthermore, $t_{ij}$ is the time in the optimal trip corresponding to distance $D_{ij}$. By definition, $t_{iN_i} - t_{i0} = T_i$. Since the train is stopped at $D_{i0}$ and $D_{iN_i}$, $v_{i0} = v_{iN_i} = 0$.

The above expression enables the function $F_i(t)$ to be alternatively determined by first determining the functions $f_{ij}(\bullet)$, $1 \le j \le N_i$, then finding $\tau_{ij}$, $1 \le j \le N_i$ and $v_{ij}$, $1 \le j < N_i$, which minimize or reduce:

$$F_i(t) = \sum_{j=1}^{N_i} f_{ij}(\tau_{ij}, v_{i,j-1}, v_{ij}) \quad \text{(Equation \#27)}$$

subject to:

$$\sum_{j=1}^{N_i} \tau_{ij} = T_i \quad \text{(Equation \#28)}$$

$$v_{min}(i, j) \le v_{ij} \le v_{max}(i, j) \quad j = 1, \ldots, N_i - 1 \quad \text{(Equation \#29)}$$

$$v_{i0} = v_{iN_i} = 0 \quad \text{(Equation \#30)}$$

By choosing $D_{ij}$ (e.g., at speed restrictions or meeting points), $v_{max}(i,j)-v_{min}(i,j)$ can be minimized or reduced, thus minimizing or reducing the domain over which $f_{ij}(\ )$ needs to be known.

Based on the partitioning above, a simpler suboptimal re-planning approach than that described above is to restrict re-planning to times when the vehicle system is at distance points $D_{ij}$, $1 \le i \le M$, $1 \le j \le N_i$. At point $D_{ij}$, the new trip plan from $D_{ij}$ to $D_M$ can be determined by finding $\tau_{ik}$, $j<k \le N_i$, $v_{ik}$, $j<k<N_i$, and $\Sigma_{mn}$, $i<m \le M$, $1 \le n \le N_m$, $v_{mn}$, $i<m \le M$, $1 \le n<N_m$, which minimize or reduce:

$$\sum_{k=j+1}^{N_i} f_{ik}(\tau_{ik}, v_{i,k-1}, v_{ik}) + \sum_{m=i+1}^{M} \sum_{n=1}^{N_m} f_{mn}(\tau_{mn}, v_{m,n-1}, v_{mn}) \quad \text{(Equation \#31)}$$

subject to:

$$t_{min}(i) \le t_{act} + \sum_{k=j+1}^{N_i} \tau_{ik} \le t_{max}(i) - \Delta t_i \quad \text{(Equation \#32)}$$

$$t_{min}(n) \le t_{act} + \sum_{k=j+1}^{N_i} \tau_{ik} + \sum_{m=i+1}^{n} (T_m + \Delta t_{m-1}) \le t_{max}(n) - \Delta t_n \quad \text{(Equation \#33)}$$

$$n = i+1, \ldots, M-1$$

$$t_{act} + \sum_{k=j+1}^{N_i} \tau_{ik} + \sum_{m=i+1}^{M} (T_m + \Delta t_{m-1}) = T \quad \text{(Equation \#34)}$$

where:

$$T_m = \sum_{n=1}^{N_m} \tau_{mn} \quad \text{(Equation \#35)}$$

A further simplification is obtained by waiting on the re-computation of $T_m$, $i<m \le M$, until distance point $D_i$ is reached. In this way, at points $D_{ij}$ between $D_{i-1}$ and $D_i$, the minimization or reducing above may need only be performed over $\tau_{ik}$, $j<k \le N_i$, $v_{ik}$, $j<k<N_i$. $T_i$ is increased as needed to accommodate any longer actual travel time from $D_{i-1}$ to $D_{ij}$ than planned. This increase is later compensated, if possible, by the re-computation of $T_m$, $i<m \le M$, at distance point $D_i$.

With respect to the closed-loop configuration disclosed above, the total input energy required to move the vehicle system 31 from point A to point B includes the sum of four components, specifically, difference in kinetic energy between points A and B; difference in potential energy between points A and B; energy loss due to friction and other drag losses; and energy dissipated by the application of brakes. Assuming the start and end speeds to be equal (e.g., stationary), the first component is zero. Furthermore, the second component is independent of driving strategy. Thus, it can suffice to minimize or reduce the sum of the last two components.

Following a constant speed profile can minimize or reduce drag loss. Following a constant speed profile also can minimize or reduce total energy input when braking is not needed to maintain constant speed. If braking is required to maintain constant speed, however, applying braking just to maintain constant speed is likely to increase total required energy because of the need to replenish the energy dissipated by the brakes. A possibility exists that some braking may actually reduce total energy usage if the additional brake loss is more than offset by the resultant decrease in drag loss caused by braking, by reducing speed variation.

After completing a re-plan from the collection of events described above, the new optimal notch/speed plan can be followed using the closed loop control described herein. However, in some situations there may not be enough time to carry out the segment decomposed planning described above, and particularly when there are critical speed restrictions that must be respected, an alternative may be needed. One or more embodiments of the inventive subject matter accomplish this with an algorithm referred to as "smart cruise control." The smart cruise control algorithm is an efficient way to generate, on the fly, an energy-efficient (hence fuel-efficient) sub-optimal prescription for driving the vehicle system 31 over a known terrain. This algorithm assumes knowledge of the position of the vehicle system 31 along the route 34 at all times, as well as knowledge of the grade and curvature of the route versus position. The method can use a point-mass model for the motion of the vehicle system 31, whose parameters may be adaptively estimated from online measurements of motion of the vehicle system, as described earlier.

In one embodiment, the smart cruise control algorithm has three components, specifically, a modified speed limit profile that serves as an energy-efficient (and/or emissions efficient or any other objective function) guide around speed limit reductions; an ideal throttle or dynamic brake setting profile that attempts to balance between minimizing or reducing speed variation and braking; and a mechanism for combining the latter two components to produce a notch command, employing a speed feedback loop to compensate for mismatches of modeled parameters when compared to reality parameters. Smart cruise control can accommodate strategies in embodiments of the inventive subject matter that do no active braking (e.g., the driver is signaled and assumed to provide the requisite braking) or a variant that does active braking.

With respect to the cruise control algorithm that does not control dynamic braking, the three components are a modified speed limit profile that serves as an energy-efficient guide around speed limit reductions, a notification signal directed to notify the operator when braking should be applied, an ideal throttle profile that attempts to balance between minimizing or reducing speed variations and notifying the operator to apply braking, a mechanism employing a feedback loop to compensate for mismatches of model parameters to reality parameters.

Also included in one or more embodiments of the inventive subject matter is an approach to identify key parameter values of the vehicle system 31. For example, with respect to estimating vehicle system mass, a Kalman filter, and a recursive least-squares approach may be utilized to detect errors that may develop over time.

Figure 9:
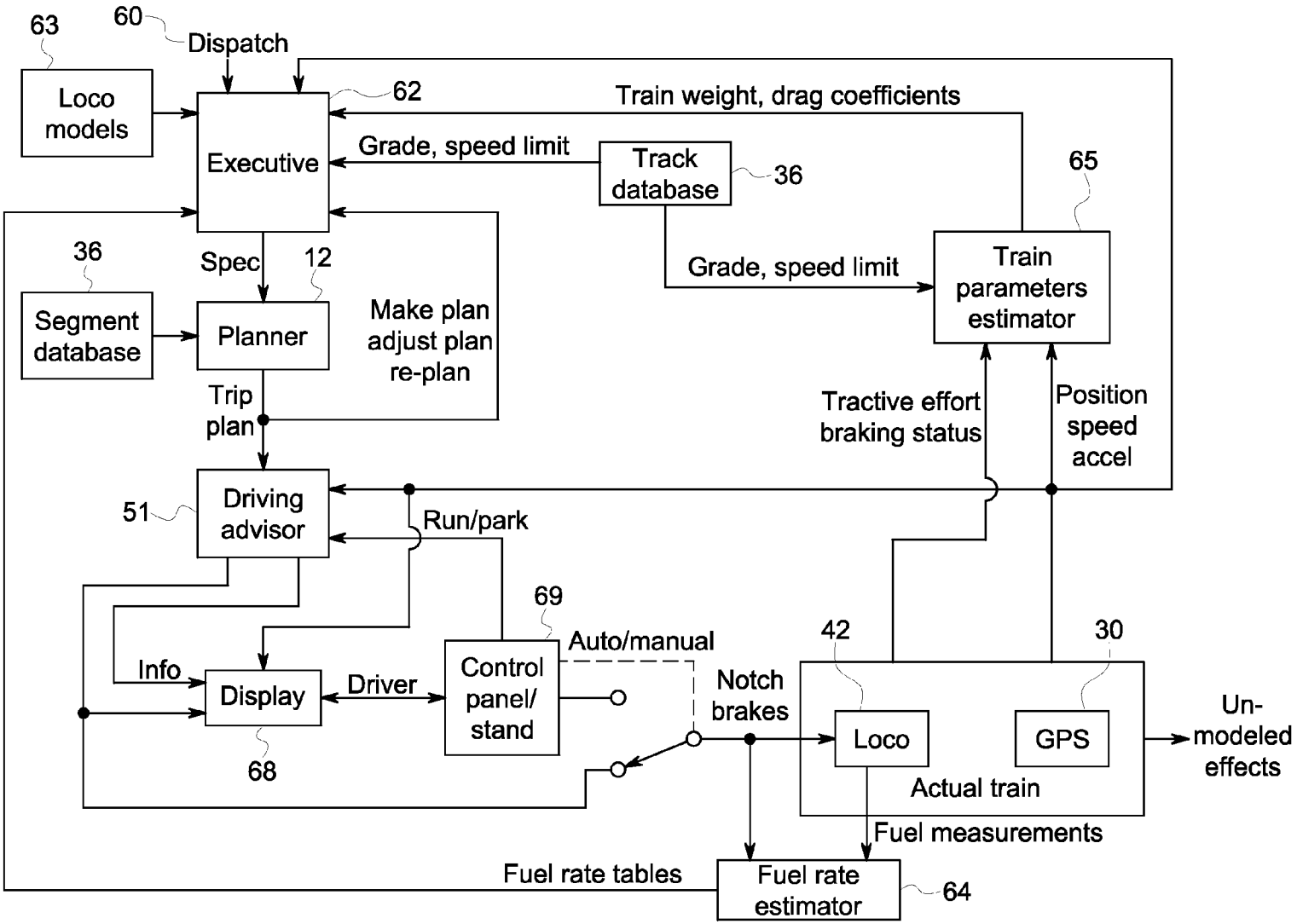
FIG. 9 depicts another flow chart of one embodiment of trip optimization.

FIG. 9 depicts a flow chart of one embodiment of the inventive subject matter. As discussed previously, a remote facility, such as a dispatch 60, can provide information. As illustrated, such information is provided to an executive control element 62. Also supplied to the executive control element 62 is information from a vehicle modeling database 63, information from the route database 36 such as, but not limited to, route grade information and speed limit information, estimated train parameters such as, but not limited to, vehicle system weight and drag coefficients, and fuel rate tables from a fuel rate estimator 64. The executive control element 62 supplies information to the planner 12, which is disclosed in more detail in FIG. 1. Once a trip plan has been calculated, the plan is supplied to a driving advisor, driver, or controller element 51. The trip plan is also supplied to the executive control element 62 so that it can compare the trip when other new data is provided.

As discussed above, the driving advisor 51 can automatically set a notch power, either a pre-established notch setting or an optimum continuous notch power. In addition to supplying a speed command to the powered vehicle 42, a display 68 is provided so that the operator can view what the planner has recommended. The operator also has access to a control panel 69. Through the control panel 69 the operator can decide whether to apply the notch power recommended. Towards this end, the operator may limit a targeted or recommended power. That is, at any time the operator may have final authority over what power setting the consist will operate at. This includes deciding whether to apply braking if the trip plan recommends slowing the vehicle system 31. For example, if operating in dark territory, or where information from wayside equipment cannot electronically transmit information to a vehicle system and instead the operator views visual signals from the wayside equipment, the operator inputs commands based on information contained in the route database and visual signals from the wayside equipment. Based on how the vehicle system 31 is functioning, information regarding fuel measurement is supplied to the fuel rate estimator 64. Since direct measurement of fuel flows is not typically available in a consist, the information on fuel consumed so far within a trip and projections into the future following trip plans can be carried out using calibrated physics models such as those used in developing the optimal plans. For example, such predictions may include, but are not limited to, the use of measured gross horsepower and known fuel characteristics and emissions characteristics to derive the cumulative fuel used and emissions generated.

The vehicle system 31 also has the locator device 30 such as a GPS sensor, as discussed above. Information is supplied to the train parameters estimator 65. Such information may include, but is not limited to, GPS sensor data, tractive/braking effort data, braking status data, speed, and any changes in speed data. With information regarding grade and speed limit information, vehicle system weight and drag coefficients information is supplied to the executive control element 62.

Embodiments of the inventive subject matter may also allow for the use of continuously variable power throughout the optimization planning and closed loop control implementation. In a conventional locomotive, power is typically quantized to eight discrete levels. Modern locomotives can realize continuous variation in horsepower which may be incorporated into the previously described optimization methods. With continuous power, a locomotive can further optimize operating conditions, e.g., by minimizing or reducing auxiliary loads and power transmission losses, and fine tuning engine horsepower regions of optimum or increased efficiency, or to points of decreased emissions margins. Example include, but are not limited to, minimizing or reducing cooling system losses, adjusting alternator voltages, adjusting engine speeds, and reducing number of powered axles. Further, the locomotive may use the on-board route database 36 and the forecasted performance requirements to minimize or reduce auxiliary loads and power transmission losses to provide optimum or increased efficiency for the target fuel consumption/emissions. Examples include, but are not limited to, reducing a number of powered axles on flat terrain and precooling the locomotive engine prior to entering a tunnel.

One or more embodiments of the inventive subject matter may also use the on-board route database 36 and the forecasted performance to adjust the performance of the powered vehicle 42, such as to insure that the vehicle system 31 has sufficient speed as the vehicle system 31 approaches a hill and/or tunnel. For example, this could be expressed as a speed constraint at a particular location that becomes part of the optimal plan generation created solving the Equation (OP). Additionally, one or more embodiments of the inventive subject matter may incorporate vehicle-handling rules, such as, but not limited to, tractive effort ramp rates and upper limits on braking effort ramp rates. These may be incorporated directly into the formulation for the trip plan or alternatively incorporated into the closed loop regulator used to control power application to achieve the target speed.

In one embodiment, the trip planning system is only installed on a lead powered vehicle of the consist. Even though one or more embodiments of the inventive subject matter are not dependant on data or interactions with other powered vehicles, the trip planning system may be integrated with a consist manager, as disclosed in U.S. Pat. No. 6,691,957 and U.S. Pat. No. 7,021,588 (both of which are incorporated by reference), functionality and/or a consist optimizer functionality to improve efficiency. Interaction with multiple vehicle systems is not precluded, as illustrated by the example of dispatch arbitrating two "independently optimized" trains described herein.

Trains with DP systems can be operated in different modes. One mode is where all locomotives in the train operate at the same notch command. So if the lead locomotive is commanding motoring—N8, all units in the train will be commanded to generate motoring—N8 power. Another mode of operation is "independent" control. In this mode, locomotives or sets of locomotives distributed throughout the train can be operated at different motoring or braking powers. For example, as a train crests a mountaintop, the lead locomotives (on the down slope of mountain) may be placed in braking, while the locomotives in the middle or at the end of the train (on the up slope of mountain) may be in motoring. This is done to minimize or reduce tensile forces on the mechanical couplers that connect the railcars and locomotives. Traditionally, operating the distributed power system in "independent" mode required the operator to manually command each remote locomotive or set of locomotives via a display in the lead locomotive. Using the physics based planning model, train set-up information, on-board track database, on-board operating rules, location determination system, real-time closed loop power/brake control, and sensor feedback, the system is able to automatically operate the distributed power system in "independent" mode.

When operating in DP, the operator in a lead locomotive can control operating functions of remote locomotives in the remote consists via a control system, such as a distributed power control element. Thus when operating in DP, the operator can command each locomotive consist to operate at a different notch power level (or one consist could be in motoring and another could be in braking), wherein each individual locomotive in the locomotive consist operates at the same notch power. In an embodiment, with the trip planning system installed on the train, preferably in communication with the DP control element, when a notch power level for a remote locomotive consist is desired as recommended by the trip plan, the trip planning system can communicate this power setting to the remote locomotive consists for implementation. As discussed below, the same is true regarding braking.

One or more embodiments of the inventive subject matter may be used with consists in which the powered vehicles are not contiguous, e.g., with 1 or more powered vehicles up front and others in the middle and/or at the rear of a vehicle system.

Such configurations may be referred to as DP, wherein the standard connection between the locomotives is replaced by radio link or auxiliary cable to externally link the powered vehicles. When operating in DP, the operator in a lead locomotive can control operating functions of remote locomotives in the consist via a control system, such as a distributed power control element. In particular, when operating in distributed power, the operator can command each locomotive consist to operate at a different notch power level (or one consist could be in motoring and other could be in braking), wherein each individual in the locomotive consist operates at the same notch power.

In an embodiment, with the trip planning system installed on a vehicle system, preferably in communication with the DP control element, when a notch power level for a remote consist is desired as recommended by the trip plan, the trip planning system can communicate this power setting to the remote consists for implementation. As discussed below, the same is true regarding braking. When operating with distributed power, the optimization problem previously described can be enhanced to allow additional degrees of freedom, in that each of the remote consists or powered vehicles can be independently controlled from the lead unit. The value of this is that additional objectives or constraints relating to in-train forces may be incorporated into the performance function, assuming the model to reflect the in-system forces is also included. Thus, one or more embodiments of the inventive subject matter may include the use of multiple throttle controls to better manage in-system forces as well as fuel consumption and emissions.

In a train utilizing a consist manager, the lead locomotive in a locomotive consist may operate at a different notch power setting than other locomotives in that consist. The other locomotives in the consist operate at the same notch power setting. One or more embodiments of the inventive subject matter may be utilized in conjunction with the consist manager to command notch power settings for the locomotives in the consist. Thus, based on one or more embodiments of the inventive subject matter, since the consist manager divides a locomotive consist into two groups, namely, lead locomotive and trail units, the lead locomotive will be commanded to operate at a certain notch power and the trail locomotives are commanded to operate at another certain notch power. In one embodiment, the distributed power control element may be the system and/or apparatus where this operation is housed.

Likewise, when a consist optimizer is used with a locomotive consist, one or more embodiments of the inventive subject matter can be used in conjunction with the consist optimizer to determine notch power for each locomotive in the locomotive consist. For example, suppose that a trip plan recommends a notch power setting of 4 for the locomotive consist. Based on the location of the train, the consist optimizer will take this information and then determine the notch power setting for each locomotive in the consist. In this implementation, the efficiency of setting notch power settings over intra-train communication channels is improved. Furthermore, as discussed above, implementation of this configuration may be performed utilizing the distributed control system.

Furthermore, as discussed previously, one or more embodiments of the inventive subject matter may be used for continuous corrections and re-planning with respect to when the train consist uses braking based on upcoming items of interest, such as but not limited to, railroad crossings, grade changes, approaching sidings, approaching depot yards, and approaching fuel stations, where each locomotive in the consist may require a different braking option. For example, if the train is coming over a hill, the lead locomotive may have to enter a braking condition, whereas the remote locomotives, having not reached the peak of the hill may have to remain in a motoring state.

Figure 10:
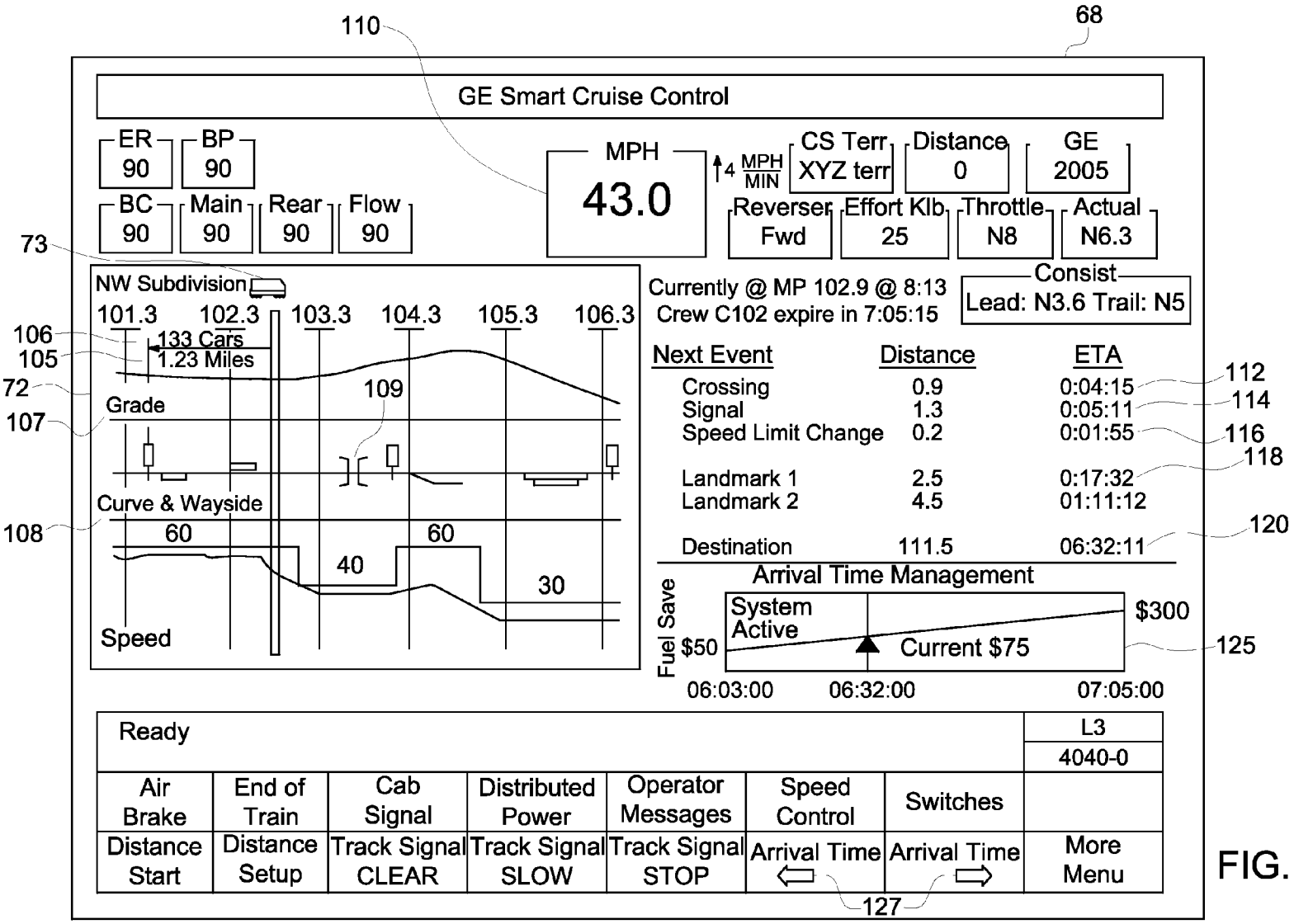
FIG. 10 depicts an illustration of a dynamic display for use by an operator.

FIGS. 8, 9, and 10 depict exemplary illustrations of dynamic displays for use by the operator. As shown in FIG. 10, a trip plan 72 is provided in the form of a rolling map 400. Within the profile a location 73 of the vehicle system or powered vehicle is provided. Such information as vehicle system length 105 and the number of vehicles (e.g., cars) 106 in the vehicle system is also provided. Display elements are also provided regarding route grade 107, curve and wayside elements 108, including bridge location 109, and speed 110. The display 68 allows the operator to view such information and also see where the vehicle system is along the route. Information pertaining to distance and/or estimated time of arrival to such locations as crossings 112, signals 114, speed changes 116, landmarks 118, and destinations 120 is provided. An arrival time management tool 125 is also provided to allow the user to determine the fuel savings that is being realized during the trip. The operator has the ability to vary arrival times 127 and witness how this affects the fuel savings. As discussed herein, other parameters discussed herein can be viewed and evaluated with a management tool that is visible to the operator. The operator is also provided information about how long the crew has been operating the train. In one or more embodiments, time and distance information may either be illustrated as the time and/or distance until a particular event and/or location, or it may provide a total time.

Figure 11:
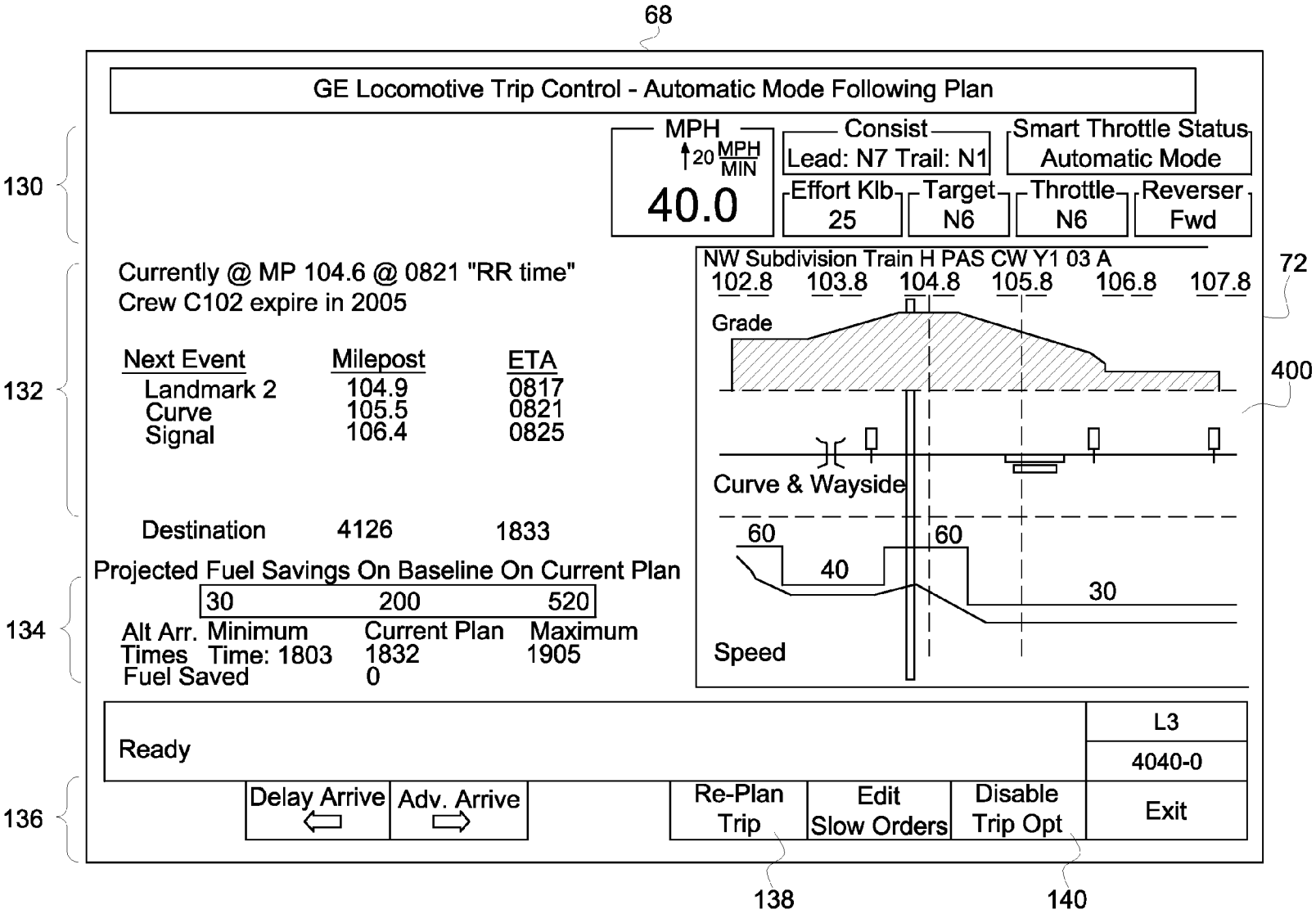
FIG. 11 depicts another illustration of a dynamic display for use by the operator.

As illustrated in FIG. 11, an exemplary display provides information about consist data 130, an events and situation graphic 132, an arrival time management tool 134, and action keys 136. Similar information as discussed above is provided in this display as well. This display 68 also provides action keys 138 to allow the operator to re-plan as well as to disengage 140 the trip planning system.

Figure 12:
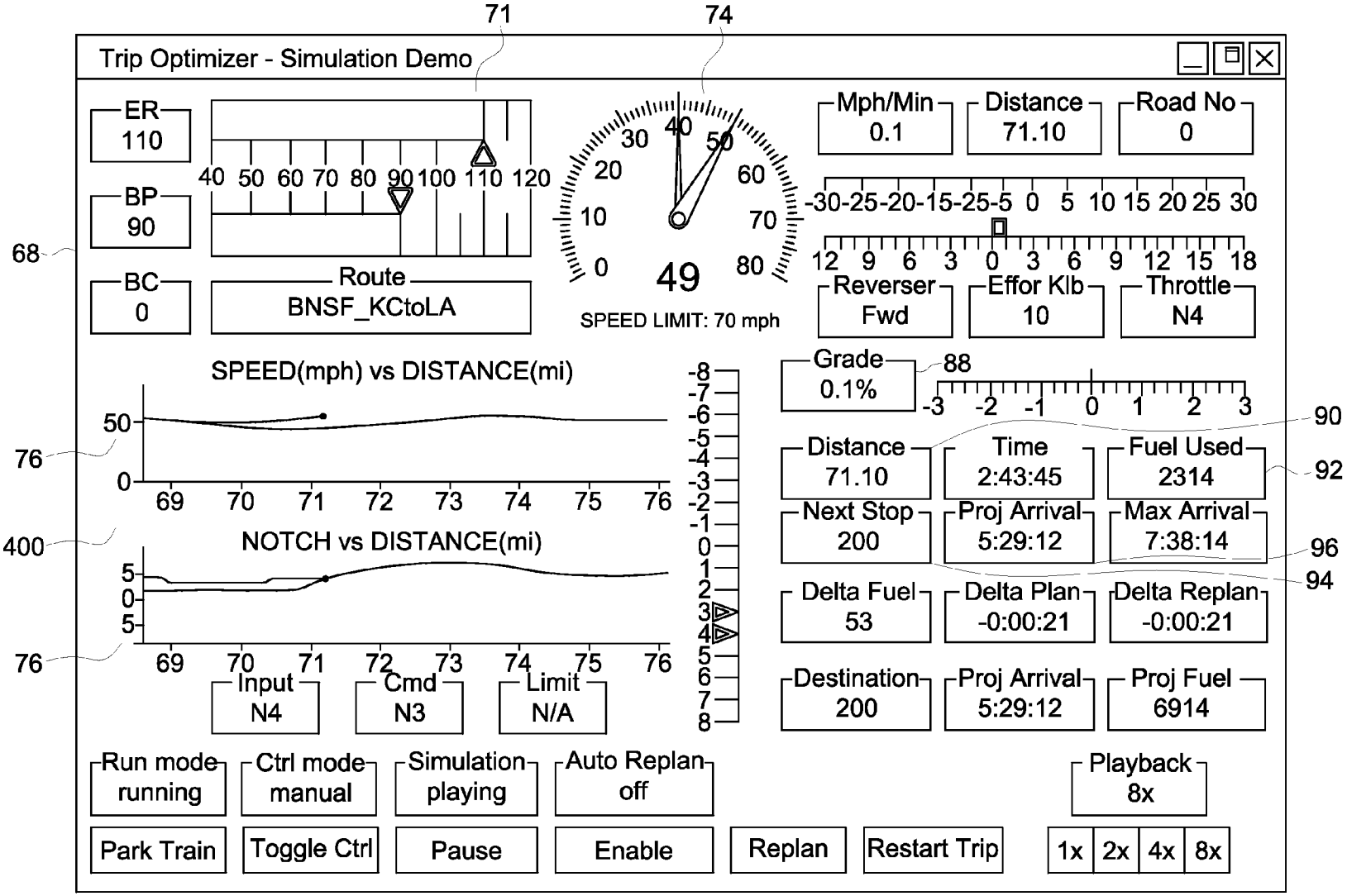
FIG. 12 depicts another illustration of a dynamic display for use by the operator.

FIG. 12 depicts another embodiment of the display. Data typical of a modern locomotive including air-brake status 71, analog speedometer with digital insert, or indicator, 74, and information about tractive effort in pounds force (or traction amps for DC locomotives) is visible. An indicator 74 is provided to show the current optimal speed in the plan being executed, as well as an accelerometer graphic to supplement the readout in mph/minute. Important new data for optimal plan execution is in the center of the screen, including a rolling strip graphic 76 with optimal speed and notch setting versus distance compared to the current history of these variables. In this embodiment, the location of the train is derived using the locator element. As illustrated, the location is provided by identifying how far the train is away from its final destination, an absolute position, an initial destination, an intermediate point, and/or an operator input.

The strip chart provides a look-ahead to changes in speed required to follow the optimal plan, which is useful in manual control, and monitors plan versus actual during automatic control. As discussed herein, such as when in the coaching mode, the operator can follow either the notch or speed suggested by one or more embodiments of the inventive subject matter. The vertical bar gives a graphic of desired and actual notch, which are also displayed digitally below the strip chart. When continuous notch power is utilized, as discussed above, the display will simply round to the closest discrete equivalent. The display may be an analog display so that an analog equivalent or a percentage or actual horse power/tractive effort is displayed.

Critical information on trip status is displayed on the screen, and shows the current grade the train is encountering 88, either by the lead locomotive, a location elsewhere along the train, or an average over the train length. A distance traveled so far in the plan 90, cumulative fuel used 92, where the next stop is planned 94 (or a distance away therefrom), current and projected arrival time 96, and expected time to be at next stop are also disclosed. The display 68 also shows the maximum possible time to destination possible with the computed plans available. If a later arrival was required, a re-plan would be carried out. Delta plan data shows status for fuel and schedule ahead or behind the current optimal plan. Negative numbers mean less fuel or early compared to plan, positive numbers mean more fuel or late compared to plan, and typically trade-off in opposite directions (slowing down to save fuel makes the train late and conversely).

At all times, these displays 68 give the operator a snapshot of where he stands with respect to the currently instituted driving plan. This display is for illustrative purpose only as there are many other ways of displaying/conveying this information to the operator and/or dispatch. Toward this end, the information disclosed herein could be intermixed to provide a display different than the ones disclosed.

Figure 13:
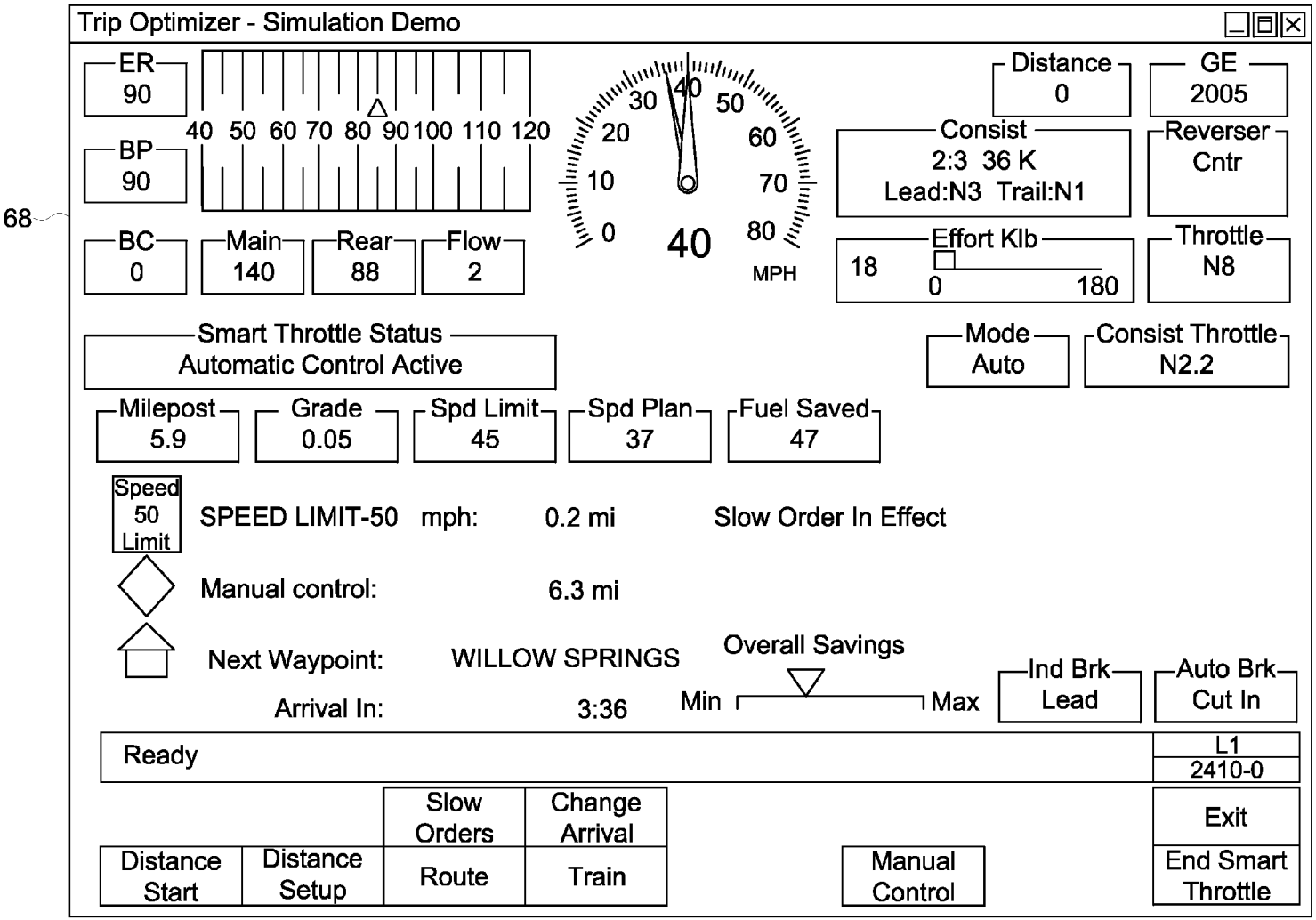
FIG. 13 depicts another illustration of a dynamic display for use by the operator.
Figure 14:
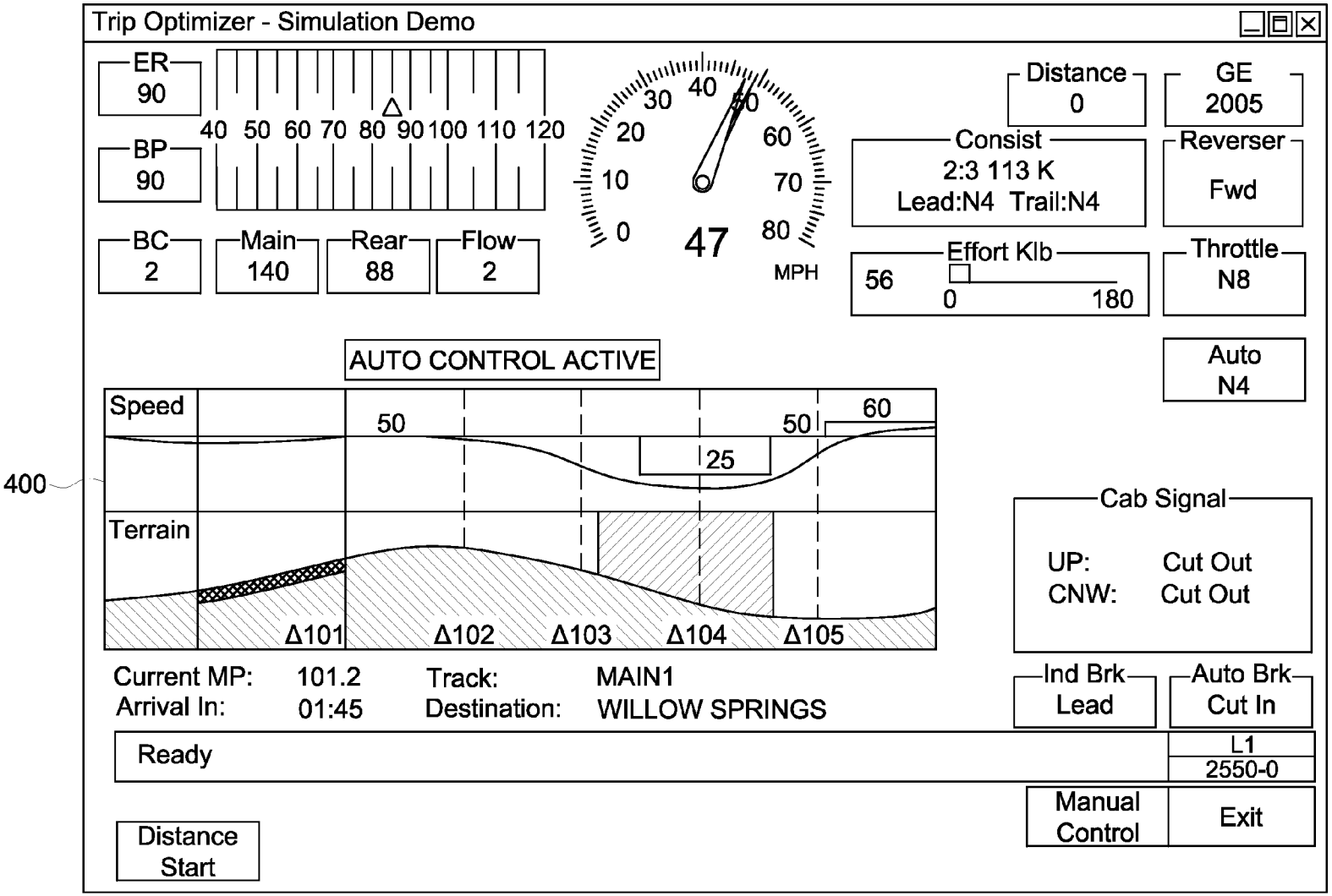
FIG. 14 depicts another illustration of a dynamic display for use by the operator.

FIG. 13 depicts another illustration of a dynamic display for use by the operator. In this display, the current location, grade, speed limit, plan speed and fuel saved are displayed as current numerical values rather than in graphical form. In this display, the use of an event list is used to inform the operator of upcoming events or landmarks rather than a rolling map or chart.

In an additional embodiment, a method may be utilized to enter vehicle manifest and general route bulletin information on the powered vehicle. Such information may be entered manually using the existing operating displays 68 or a new input device. Also, vehicle manifest and general route bulletin information may be entered through a maintenance access point, using portable media or via portable test unit program. Additionally, such information may be entered through a wireless transfer through a railroad communications network, as another example. The amount of manifest and general route bulletin information can be configured based upon the type of data entry method. For example, the per car load information may not be included if data entry is performed manually, but could be included if data entry is via wireless data transfer.

Regarding the information display for an embodiment of the trip planning system, certain features and functions may be utilized by the operator. For example, a rolling map 400, as is illustrated in FIGS. 8-10, 12, 16, 17, 19, in which each data element is distinguishable from others, be may be utilized. Such a rolling map 400 may provide such information as a speed limit, whether it be a civil, temporary, turnout, signal imposed, work zones, terrain information and/or track warrant. The types of speed limits can be presented to be distinguishable from one another. Additionally, such a rolling map may provide trip plan speed information or actual speed, trip plan notch or actual notch, trip plan horsepower by the consist or the locomotive, trip plan tractive/brake effort or actual tractive/brake effort, and trip plan fuel consumption planned versus actual by any of the train, locomotive or locomotive consist. The information display may additionally display a list of events, such as is further illustrated in FIG. 13, instead of the rolling map, where such events may include a current milepost, list of events by an upcoming milepost, a list of events for alternate routes, or shaded events that are not on a current route, for example. Additionally, the information display may provide a scrolling function or scaling function to see the entire display data. A query function may also be provided to display any section of the track or the plan data.

Figure 15:
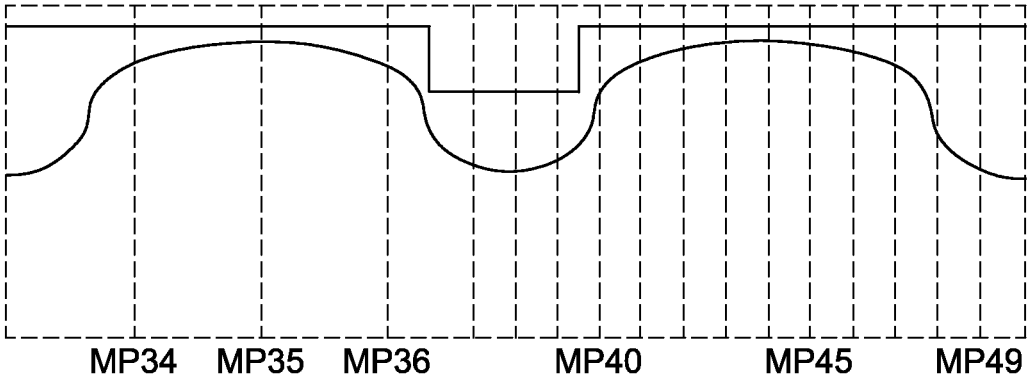
FIG. 15 depicts an illustration of a portion of the dynamic display.
Figure 16:
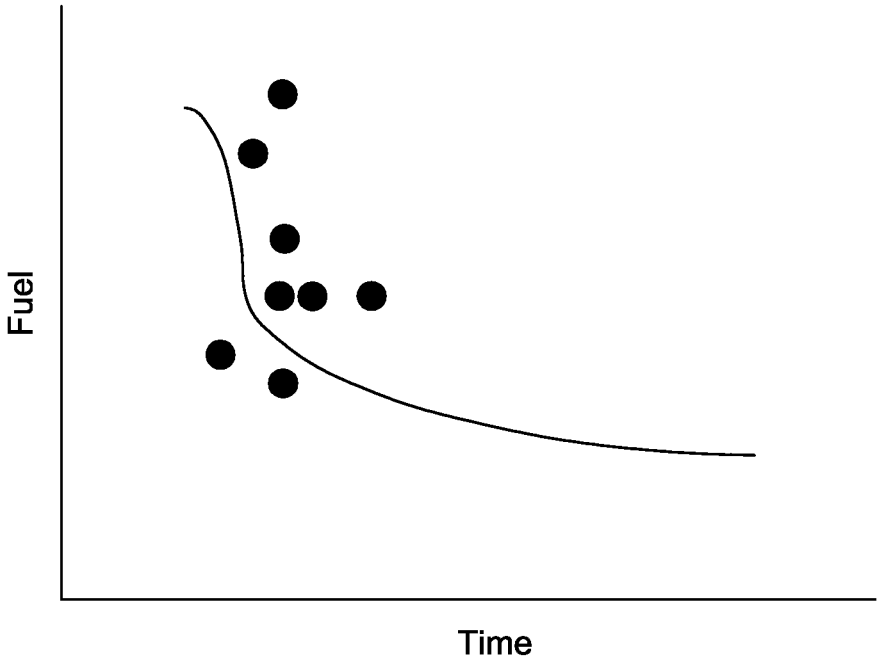
FIG. 16 depicts another illustration for a portion of the dynamic display.

The information display, in addition to those features mentioned above, may also provide a map with a variable setting of the x-axis, including expanded and compressed views on the screen, such as is illustrated in FIG. 15. For example, the first 3 miles (4.828 kilometers) 402 may be viewed in the normal view, while the next 10 miles (16.09 kilometers) 404 may be viewed in the compressed view at the end of the rolling map 400. This expanded and compressed view could be a function of speed (for example at low speeds short distances are visible in detail and high speeds longer distances are visible), as a function of the type of train, as a function of the terrain variations, as a function of activity (example grade crossings, signal lights etc). Additionally, as is illustrated in FIG. 16, the information display may show historical data for the trip by horsepower/ton, and show current fuel savings versus historical fuel savings.

Figure 17A:
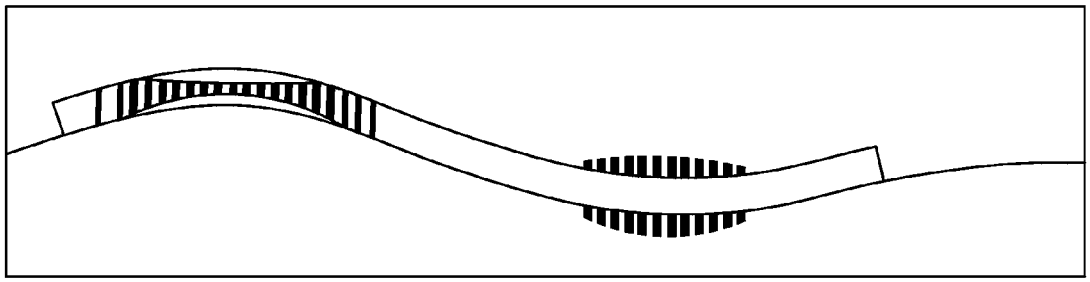
FIG. 17A depicts an illustration of a train state displayed on the dynamic display.
Figure 17B:
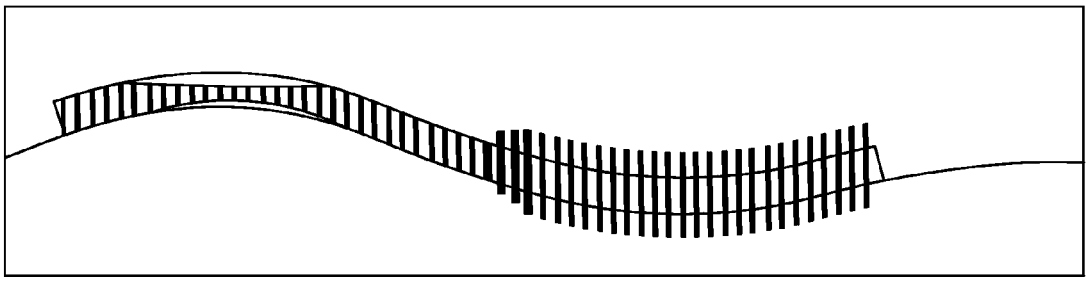
FIG. 17B depicts another illustration of a train state displayed on the dynamic display.
Figure 17C:
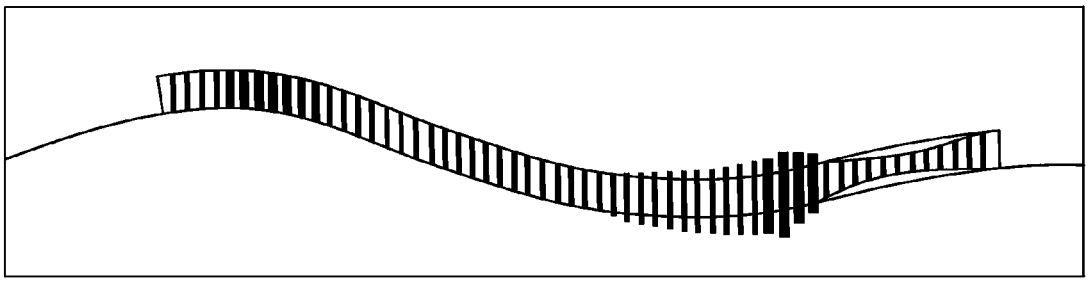
FIG. 17C depicts another illustration of a train state displayed on the dynamic display screen.
Figure 18:
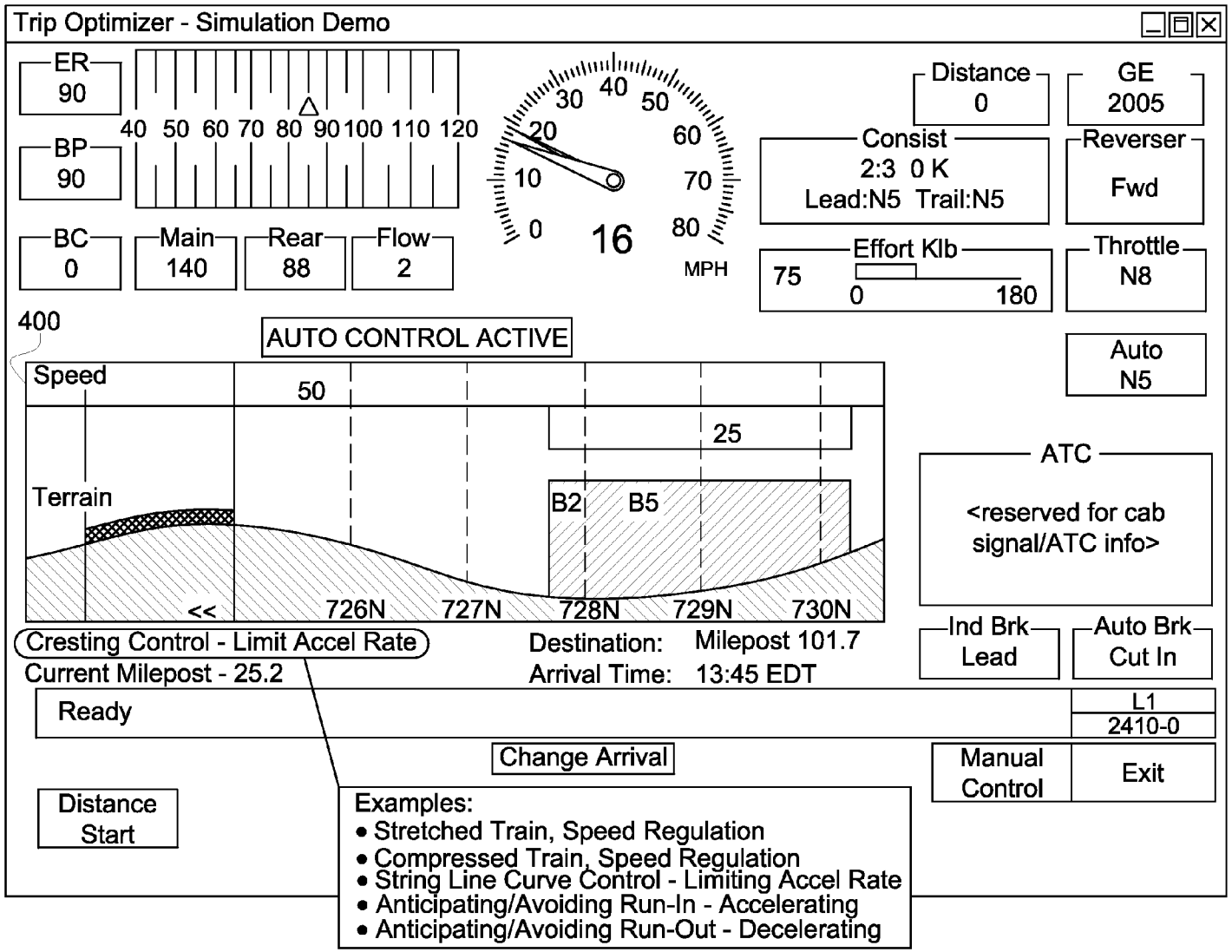
FIG. 18 depicts an exemplary illustration of the dynamic display being used as a training device.
Figure 19:
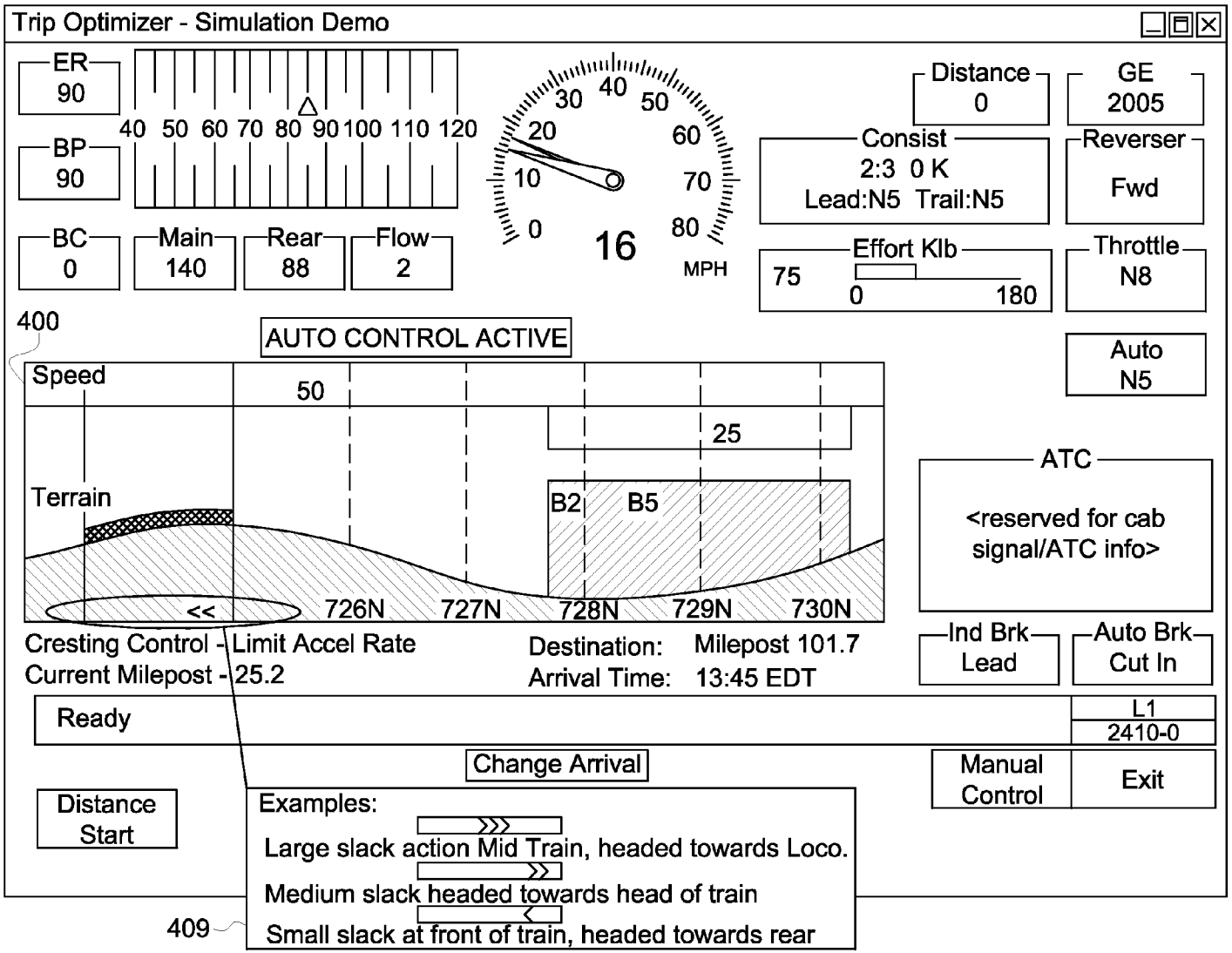
FIG. 19 depicts another illustration of the in-train forces being display on the dynamic display screen.

Additionally, as is further illustrated in FIGS. 17-19, the exemplary embodiment of the present invention may include a display of impending actions which form a unique set of data and features available on the display to the operator as a function of the trip optimizer. Such items may include, but are not limited to a unique display of tractive effort (TE)/buffer (Buff) forces in the train and the limit, a display of the point in the train where peak forces exist, a display of the "reasons" for the actions of the system. This information may be displayed at all times, and not just when the powered system is operating in an automatic and/or autonomous mode. The display may be modified as a function of the limit in effect, such as train forces, acceleration, etc.

For example, FIG. 17 discloses a visual train state graphic representing magnitude of a stretched or bunched train state. A train 42 is illustrated where part of the train 42 is in a valley 406 and another part is on a crest 408. FIG. 17A is a graphical representation that the stretch of the train over the crest is acceptable and that the bunch in the valley is also acceptable. FIG. 17B illustrates that due to braking too hard when leaving the valley, run-in, more specifically a situation when the cars on the train may run into each other, is building up in the train. FIG. 17C illustrates a situation where the train has been accelerated too quickly as it leaves the valley, creating a run-out, or pull between the cars, moving back through the train. The forces may be illustrated a plurality of ways including with an addition of color when the forces are increasing or by larger symbols where forces are increasing.

The graphics illustrated in FIGS. 17A-C may be included in the display, rolling map 400 disclosed in FIG. 18. The exemplary displays disclosed herein may also be used to train operators. For example, when operating in an automatic or autonomous mode, trip optimization information, including handling maneuvers, is displayed to the operator to assist the operator in learning. For a small portion of the mission, typically selected by the railroad owner, the trip optimizer will release control of the powered system to the operator for manual control. Data logs capturing information pertaining to the operator's performance. While in manual mode, train state information and associated handling information is still provided via the display to the operator.

FIG. 19 discloses a display illustrating an embodiment of an approach for displaying in-train forces to an operator. FIGS. 17A-C disclosed one exemplary approach to illustrate in-train forces. In another exemplary embodiment symbols 409 are provided where a number of the symbols 409 further illustrate the extent of in-train forces. Based on the direction of the symbols the direction may illustrate the direction of the forces.

In the illustrated embodiment, a display of information regarding arrival time management may be shown. The arrival time may be shown on the operational display and can be selectively shown by the customer. The arrival time data may be shown on the rolling map, such as but not limited to in a fixed time and/or range format. Additionally, it may be shown as a list of waypoints/stations with arrival times where arrival time may be wall-clock time or travel time. A configurable/selectable representation of the time, such as a travel time or wall-clock time or coordinated time universal (UTC) may be used. The arrival times and current arrival time may be limited by changing each waypoint. The arrival times may be selectively changed by the waypoints. Additionally, work/stop events with dwell times may be displayed, in addition to meet and pass events with particular times.

Figure 20:
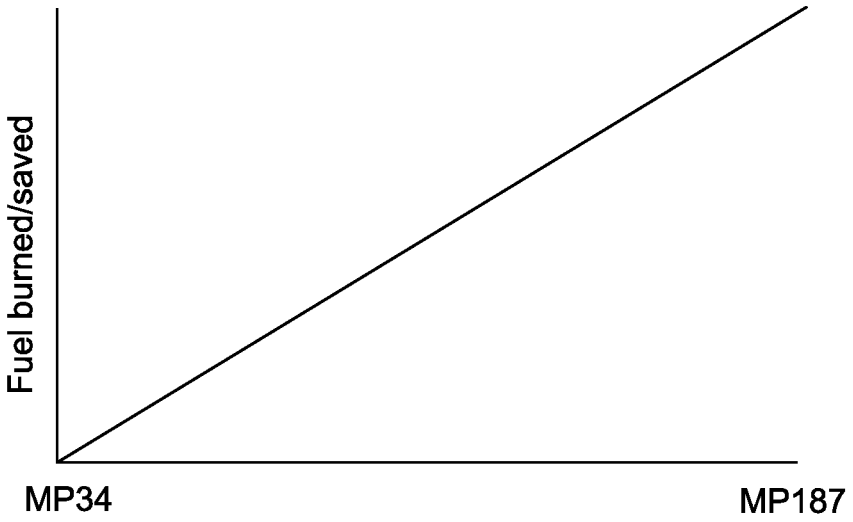
FIG. 20 depicts another illustration for a portion of the dynamic display screen.

Additionally, the illustrated embodiment may feature a display of information regarding fuel management, such as displaying travel time versus fuel trade off, including intermediate points. Additionally, the exemplary embodiment may display fuel savings versus the amount of fuel burned for the trip, such as is illustrated in FIG. 20.

The illustrated embodiment additionally includes displaying information regarding the train manifest or trip information. An operating display will provide the ability for entry of data, modification of the data, confirmation of the data, alpha keypad on the screen, a configurable data set based on method of data entry, and inputting a route with a start and end location and intermediate point (i.e., waypoints). The waypoints may be based on a comprehensive list or intelligent pick list, based on the direction of the train, train ID, etc, a milepost, alpha searching, or scrolling a map with selection keys. Additionally, the operating display takes into account unique elements for locomotive consist modification, including power level/type, motoring status, dynamic brake status, isolated, the health of power (i.e., load pot), the number of axles available for power and braking, dead in tow, and air brake status.

Figure 21A:
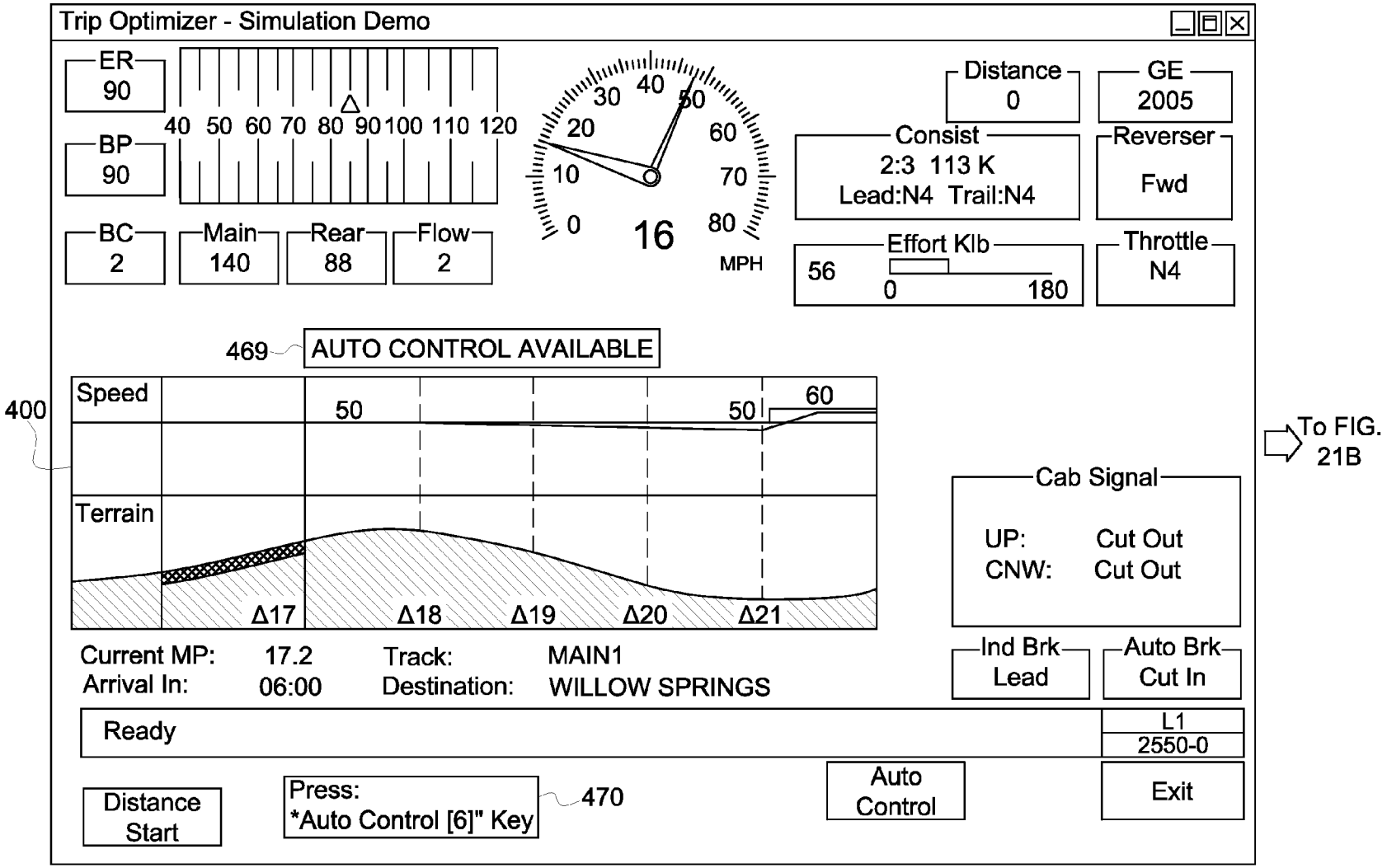
FIG. 21A depicts an illustration of a dynamic display screen notifying the operator when to engage the automatic controller.
Figure 21B:
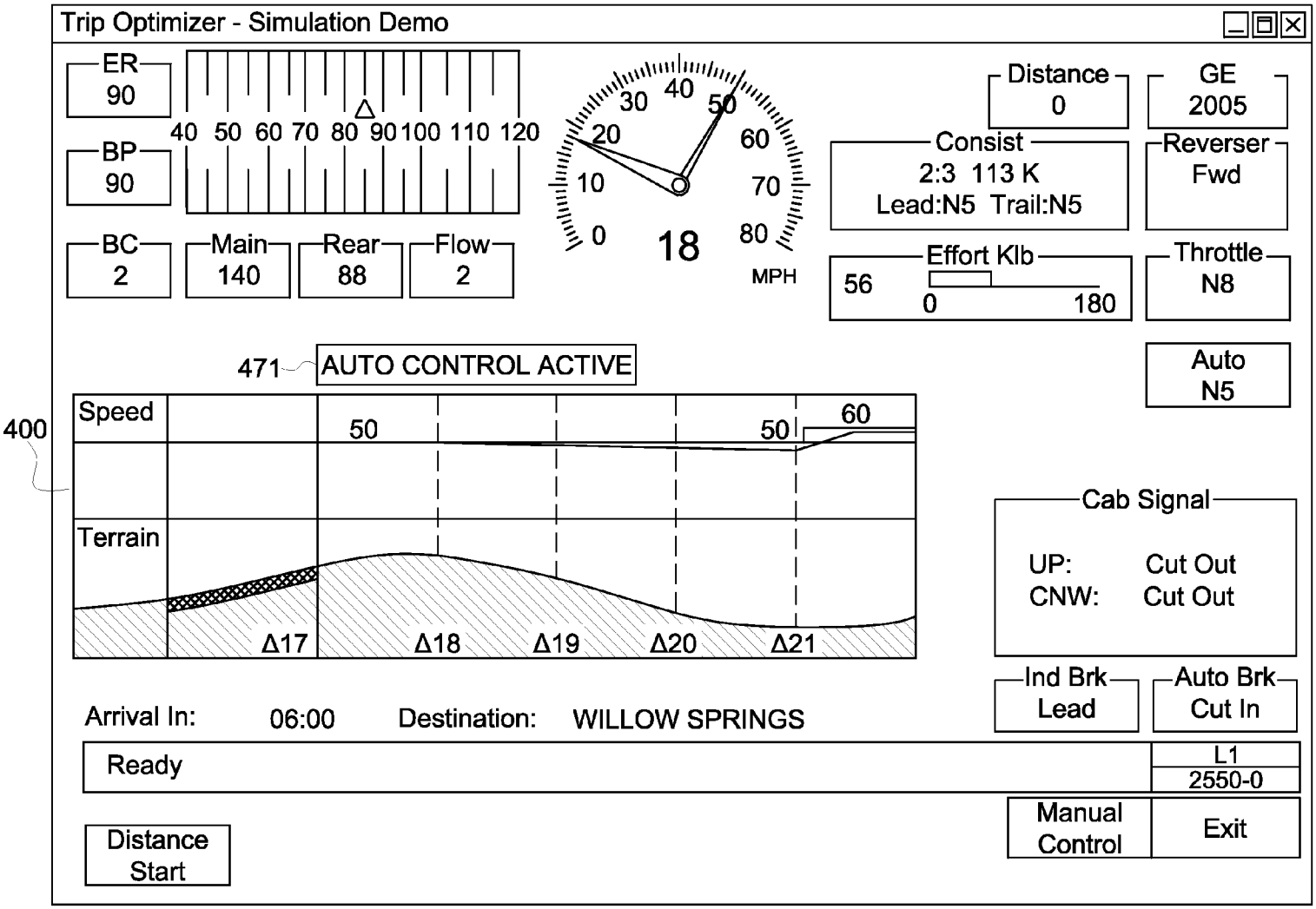
FIG. 21B depicts an illustration of a dynamic display screen notifying the operator when automatic controller is engaged.

The illustrated embodiment also provides for changing control from manual control to automatic control (during motoring). FIG. 21A depicts an exemplary illustration of a dynamic display screen notifying the operator when to engage the automatic controller. A notice 469 is provided signifying that automatic control is available. In one embodiment, the operator initiates some action to let the system know that he/she desires the system to take control. Such action may include applying a key 470 to the screen or a hardware switch, or some other input device. Following this action, the system determines that the operator desires automatic control, and the operator may move the throttle to several positions selectively determined. For example, such positions may include idle/notch 1/notch 8 or any notch, and by positioning the throttle in one of these positions, the operator permits full control of power to the system. A notice is displayed to the operator regarding which notch settings are available. In another exemplary embodiment, if the throttle is able to be moved to any notch, the controller may choose to limit a maximum power or upper limit on power that can be applied or operated at any power setting regardless of throttle handle position. As another example of selecting automatic control, the operator may select an engine speed and the system will use the analog trainlines or other trainline communications, such as but not limited to DB modem, to make power up to the available horsepower for that engine speed selected by the throttle notch or to full power regardless of the notch position. A relay, switch or electronic circuits can be used to break the master controller cam inputs into the system to allow full control over the throttle on the lead and trail consists. The control can use digital outputs to control and drive the desired trainlines. FIG. 21B depicts an exemplary illustration of the dynamic display screen after automatic control is entered. As illustrated, a notice 471 states that automatic control is active.

As disclosed above, similar information may be relayed to the operator when the powered system is remotely controlled so that the operator will know how to operate the remotely controlled powered system.

In one embodiment, a system (e.g., for remotely controlling movement of a vehicle) includes a feedforward element and a feedback element. The feedforward element is configured to be disposed onboard a remotely controlled vehicle and to receive an operator command for the vehicle from an operator control unit disposed off-board of the vehicle. The feedforward element also is configured to predict movements of the vehicle over an upcoming segment of a route being traveled by the vehicle based on the operator command and terrain information of the upcoming segment of the route. The feedback element is configured to be disposed onboard the vehicle and to determine an actual movement of the vehicle. The feedforward element is configured to communicate the predicted movements of the vehicle to the operator control unit and the feedback element is configured to communicate the actual movement of the vehicle to the operator control unit such that an operator can examine the predicted movements and the actual movement in order to remotely control the vehicle.

In one aspect, the terrain information represents of at least one of grade or curvature of the upcoming segment of the route.

In one aspect, the operator command includes at least one of a designated speed of the vehicle, a location that the vehicle is to travel to within a designated time limit, or a distance within which the vehicle is to stop.

In one aspect, the feedforward element is configured to predict a throttle profile as the predicted movements of the vehicle. The throttle profile is based on the terrain information and the operator command, and represents throttle settings of the vehicle expressed as a function of at least one of distance along the route or time in order to cause the vehicle to maintain a designated speed provided by the operator command.

In one aspect, the feedforward element is configured to predict a speed profile as the predicted movements of the vehicle. The speed profile is based on the terrain information and the operator command, and represents predicted speeds of the vehicle expressed as a function of at least one of distance along the route or time that the vehicle is predicted to travel if a throttle setting represented by the operator command is implemented by the vehicle and maintained as the vehicle travels over the upcoming segment of the route.

In one aspect, the feedforward element is configured to receive the operator command from an operator actuating the operator control unit.

In one aspect, the feedforward element is configured to obtain the terrain information from a database disposed onboard the powered vehicle.

In one aspect, the operator command is obtained from a trip plan of the powered vehicle that designates operational settings of the powered vehicle as a function of at least one of time or distance along a trip of the powered vehicle.

In one embodiment, a method (e.g., for remotely controlling movement of a vehicle) includes receiving an operator command for remotely controlling a vehicle from an operator control unit disposed off-board of the vehicle, predicting movements of the vehicle over an upcoming segment of a route being traveled by the vehicle, the predicted movements based on the operator command and terrain information of the upcoming segment of the route, and monitoring actual movement of the vehicle as the vehicle travels along the route. The actual movement includes at least one of an actual speed or actual acceleration at which the vehicle moves. The method also includes communicating the predicted movements of the vehicle and the at least one of actual speed or actual acceleration of the vehicle to the operator control unit so that an operator can use the predicted movements and the at least one of actual speed or actual acceleration to determine how to remotely control the vehicle.

In one aspect, the method also includes remotely implementing a change in a throttle setting of the vehicle using the operator control unit and after receiving the predicted movements and the at least one of actual speed or actual acceleration.

In one aspect, the terrain information represents of at least one of grade or curvature of the upcoming segment of the route.

In one aspect, the operator command includes at least one of a designated speed of the vehicle, a location that the vehicle is to travel to within a designated time limit, or a distance within which the vehicle is to stop.

In one aspect, predicting movements of the vehicle includes generating a throttle profile of the vehicle based on the terrain information and the operator command. The throttle profile represents throttle settings of the vehicle expressed as a function of at least one of distance along the route or time in order to cause the vehicle to maintain a designated speed provided by the operator command.

In one aspect, predicting movements of the vehicle includes generating a speed profile of the vehicle based on the terrain information and the operator command. The speed profile represents predicted speeds of the vehicle expressed as a function of at least one of distance along the route or time that the vehicle is predicted to travel if a throttle setting represented by the operator command is implemented by the vehicle and maintained as the vehicle travels over the upcoming segment of the route.

In one aspect, the operator command is received from an operator actuating the operator control unit.

In one aspect, the method also includes obtaining the terrain information from a database disposed onboard the powered vehicle.

In one aspect, the operator command is obtained from a trip plan of the powered vehicle that designates operational settings of the powered vehicle as a function of at least one of time or distance along a trip of the powered vehicle.

In one embodiment, an operator control unit (e.g., for a vehicle) includes an input device, a communication device, and an output device. The input device is configured to receive an operator command for a remotely controlled vehicle. The communication device is configured to transmit the operator command to a feedforward element remotely disposed onboard the vehicle. The communication device also is configured to receive predicted movements of the vehicle over an upcoming segment of a route being traveled by the vehicle and at least one of actual speed or actual acceleration of the vehicle. The predicted movements are determined by the feedforward element and based on the operator command and terrain information of the upcoming segment of the route. The output device is configured to present the predicted movements and the at least one of actual speed or actual acceleration of the vehicle to an operator such that the operator can examine the predicted movements and the at least one of actual speed or actual acceleration of the vehicle in order to remotely control the vehicle using the input device.

In one aspect, the operator command includes at least one of a designated speed of the vehicle, a location that the vehicle is to travel to within a designated time limit, or a distance within which the vehicle is to stop.

In one aspect, the terrain information is indicative of at least one of curvature or grade of the upcoming segment of the route.

In one aspect, the predicted movements of the vehicle include a throttle profile that represents throttle settings of the vehicle expressed as a function of at least one of distance along the route or time in order to cause the vehicle to maintain a designated speed provided by the operator command.

In one aspect, the predicted movements of the vehicle include a speed profile that represents predicted speeds of the vehicle expressed as a function of at least one of distance along the route or time that the vehicle is predicted to travel if a throttle setting represented by the operator command is implemented by the vehicle and maintained as the vehicle travels over the upcoming segment of the route.

While the inventive subject matter has been described with reference to various embodiments, it will be understood by those of ordinary skill in the art that various changes, omissions and/or additions may be made and equivalents may be substituted for elements thereof without departing from the spirit and scope of the inventive subject matter. Additionally, many modifications may be made to adapt a particular situation or material to the teachings of the inventive subject matter without departing from the scope thereof. Therefore, it is intended that the inventive subject matter not be limited to the particular embodiment disclosed, but that the inventive subject matter will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A system comprising:

one or more processors configured to be disposed onboard a remotely controlled vehicle, the one or more processors configured to receive an operator command for the vehicle from an operator control unit disposed off-board of the vehicle, the one or more processors also configured to predict movements of the vehicle over an upcoming segment of a route being traveled by the vehicle based on the operator command and terrain information of the upcoming segment of the route, wherein the one or more processors are configured to determine an actual movement of the vehicle, wherein the one or more processors are configured to communicate the predicted movements of the vehicle to the operator control unit and the one or more processors are configured to communicate the actual movement of the vehicle to the operator control unit such that an operator can examine the predicted movements and the actual movement in order to remotely control the vehicle, and wherein the one or more processors are configured to predict one or more of a throttle profile or a speed profile as the predicted movements of the vehicle, the throttle profile based on the terrain information and the operator command, the throttle profile representing throttle settings of the vehicle expressed as a function of at least one of distance along the route or time in order to cause the vehicle to maintain a designated speed provided by the operator command, the speed profile based on the terrain information and the operator command, the speed profile representing predicted speeds of the vehicle expressed as a function of at least one of distance along the route or time that the vehicle is predicted to travel if a throttle setting represented by the operator command is implemented by the vehicle and maintained as the vehicle travels over the upcoming segment of the route.

2. The system of claim 1, wherein the terrain information represents at least one of grade or curvature of the upcoming segment of the route.

3. The system of claim 1, wherein the operator command includes at least one of a designated speed of the vehicle, a location that the vehicle is to travel to within a designated time limit, or a distance within which the vehicle is to stop.

4. The system of claim 1, wherein the one or more processors are configured to obtain the terrain information from the database disposed onboard the powered vehicle.

5. The system of claim 1, wherein the operator command is obtained from a trip plan of the powered vehicle, the trip plan designating operational settings of the powered vehicle as a function of at least one of time or distance along a trip of the powered vehicle.

6. The system of claim 1, wherein the one or more processors are configured to one or more of receive the operator command from an operator actuating the operator control unit or obtain the terrain information from a database disposed onboard the powered vehicle.

7. A method comprising:

receiving an operator command for remotely controlling a vehicle from an operator control unit disposed off-board of the vehicle;

predicting movements of the vehicle over an upcoming segment of a route being traveled by the vehicle, the predicted movements based on the operator command and terrain information of the upcoming segment of the route;

monitoring actual movement of the vehicle as the vehicle travels along the route, the actual movement including at least one of an actual speed or actual acceleration at which the vehicle moves; and communicating the predicted movements of the vehicle and the at least one of actual speed or actual acceleration of the vehicle to the operator control unit so that an operator can use the predicted movements and the at least one of actual speed or actual acceleration to determine how to remotely control the vehicle, wherein predicting movements of the vehicle includes one or more of generating a throttle profile or a speed profile of the vehicle based on the terrain information and the operator command, the throttle profile representing throttle settings of the vehicle expressed as a function of at least one of distance along the route or time in order to cause the vehicle to maintain a designated speed provided by the operator command, the speed profile representing predicted speeds of the vehicle expressed as a function of at least one of distance along the route or time that the vehicle is predicted to travel if a throttle setting represented by the operator command is implemented by the vehicle and maintained as the vehicle travels over the upcoming segment of the route.

8. The method of claim 7, further comprising remotely implementing a change in a throttle setting of the vehicle using the operator control unit and after receiving the predicted movements and the at least one of actual speed or actual acceleration.

9. The method of claim 7, wherein the terrain information represents of at least one of grade or curvature of the upcoming segment of the route.

10. The method of claim 7, wherein the operator command includes at least one of a designated speed of the vehicle, a location that the vehicle is to travel to within a designated time limit, or a distance within which the vehicle is to stop.

11. The method of claim 7, further comprising obtaining the terrain information from a database disposed onboard the powered vehicle.

12. The method of claim 7, wherein the operator command is obtained from a trip plan of the powered vehicle, the trip plan designating operational settings of the powered vehicle as a function of at least one of time or distance along a trip of the powered vehicle.

13. The method of claim 7, wherein the operator command is received from an operator actuating the operator control unit.

14. A system comprising:

one or more processors configured to be disposed onboard a remotely controlled vehicle, the one or more processors configured to receive an operator command for the vehicle from an operator control unit disposed off-board of the vehicle, the one or more processors also configured to predict movements of the vehicle over an upcoming segment of a route being traveled by the vehicle based on the operator command and terrain information of the upcoming segment of the route, wherein one or more processors are configured to determine an actual movement of the vehicle, wherein the one or more processors are configured to communicate the predicted movements of the vehicle to the operator control unit and the one or more processors are configured to communicate the actual movement of the vehicle to the operator control unit such that an operator can examine the predicted movements and the actual movement in order to remotely control the vehicle, and wherein the one or more processors are configured to predict a throttle profile and a speed profile as the predicted movements of the vehicle, the throttle profile based on the terrain information and the operator command, the throttle profile representing throttle settings of the vehicle expressed as a function of at least one of distance along the route or time in order to cause the vehicle to maintain a designated speed provided by the operator command, the speed profile based on the terrain information and the operator command, the speed profile representing predicted speeds of the vehicle expressed as a function of at least one of distance along the route or time that the vehicle is predicted to travel if a throttle setting represented by the operator command is implemented by the vehicle and maintained as the vehicle travels over the upcoming segment of the route.

15. A method comprising:

receiving an operator command for remotely controlling a vehicle from an operator control unit disposed off-board of the vehicle;

predicting movements of the vehicle over an upcoming segment of a route being traveled by the vehicle, the predicted movements based on the operator command and terrain information of the upcoming segment of the route;

monitoring actual movement of the vehicle as the vehicle travels along the route, the actual movement including at least one of an actual speed or actual acceleration at which the vehicle moves;

communicating the predicted movements of the vehicle and the at least one of actual speed or actual acceleration of the vehicle to the operator control unit so that an operator can use the predicted movements and the at least one of actual speed or actual acceleration to determine how to remotely control the vehicle; and remotely implementing a change in a throttle setting of the vehicle using the operator control unit and after receiving the predicted movements and the at least one of actual speed or actual acceleration, wherein predicting movements of the vehicle includes one or more of generating a throttle profile or a speed profile of the vehicle based on the terrain information and the operator command, the throttle profile representing throttle settings of the vehicle expressed as a function of at least one of distance along the route or time in order to cause the vehicle to maintain a designated speed provided by the operator command, the speed profile representing predicted speeds of the vehicle expressed as a function of at least one of distance along the route or time that the vehicle is predicted to travel if a throttle setting represented by the operator command is implemented by the vehicle and maintained as the vehicle travels over the upcoming segment of the route.

16. A method comprising:

receiving an operator command for remotely controlling a vehicle from an operator control unit disposed off-board of the vehicle;

predicting movements of the vehicle over an upcoming segment of a route being traveled by the vehicle, the predicted movements based on the operator command and terrain information of the upcoming segment of the route;

monitoring actual movement of the vehicle as the vehicle travels along the route, the actual movement including at least one of an actual speed or actual acceleration at which the vehicle moves; and communicating the predicted movements of the vehicle and the at least one of actual speed or actual acceleration of the vehicle to the operator control unit so that an operator can use the predicted movements and the at least one of actual speed or actual acceleration to determine how to remotely control the vehicle, wherein predicting movements of the vehicle includes generating a throttle profile and a speed profile of the vehicle based on the terrain information and the operator command, the throttle profile representing throttle settings of the vehicle expressed as a function of at least one of distance along the route or time in order to cause the vehicle to maintain a designated speed provided by the operator command, the speed profile representing predicted speeds of the vehicle expressed as a function of at least one of distance along the route or time that the vehicle is predicted to travel if a throttle setting represented by the operator command is implemented by the vehicle and maintained as the vehicle travels over the upcoming segment of the route.

* * * * *